US007480474B2

(12) United States Patent
Muto

(10) Patent No.: US 7,480,474 B2
(45) Date of Patent: Jan. 20, 2009

(54) CHARGING APPARATUS, PROCESS CARTRIDGE, AND IMAGE FORMING APPARATUS

(75) Inventor: Kenji Muto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 359 days.

(21) Appl. No.: 11/295,733

(22) Filed: Dec. 7, 2005

(65) Prior Publication Data

US 2006/0120758 A1 Jun. 8, 2006

(30) Foreign Application Priority Data

Dec. 7, 2004 (JP) ..... 2004-354185

(51) Int. Cl.
*G03G 12/18* (2006.01)
*G03G 15/02* (2006.01)

(52) U.S. Cl. ..... 399/175; 399/115

(58) Field of Classification Search ..... 399/115, 399/175, 269

See application file for complete search history.

(56) References Cited

U.S. PATENT DOCUMENTS 5,367,365 A 11/1994 Haneda et al. ..... 355/219
5,640,229 A 6/1997 Nakahara ..... 399/119
5,995,790 A * 11/1999 Takeda ..... 399/274
6,157,792 A 12/2000 Mori et al. ..... 399/24
6,404,996 B1 6/2002 Mori et al. ..... 399/24
7,103,303 B2 * 9/2006 Suzuki et al. ..... 399/175
2002/0054773 A1 5/2002 Shirai ..... 399/269
2003/0198490 A1 * 10/2003 Sugiyama ..... 399/269

FOREIGN PATENT DOCUMENTS

JP 06-130799 A 5/1994

* cited by examiner

*Primary Examiner*—David M Gray
*Assistant Examiner*—Joseph S. Wong
(74) *Attorney, Agent, or Firm*—Fitzpatrick, Cella, Harper & Scinto

(57) ABSTRACT

A charging apparatus for electrically charging a chargeable member while magnetic particles contact to the chargeable member, includes first and second magnetic particle carrying members, the second being downstream of the first with respect to a magnetic particle feeding direction at an opposed portion where the first member and the chargeable member oppose each other. The apparatus also includes a regulating portion for regulating the amount of the magnetic particles carried on the first member, at a position upstream of the opposed portion, and first and second positioning portions for regulating movement of the first and second members. The first portion regulates the first member against movement in a moving direction of the chargeable member, and the second portion regulates the second member against its movement in a direction of contact to the chargeable member while permitting movement in the direction of movement of the chargeable member.

13 Claims, 17 Drawing Sheets

CHARGING APPARATUS, PROCESS CARTRIDGE, AND IMAGE FORMING APPARATUS

FIELD OF THE INVENTION AND RELATED ART

The present invention relates to a charging apparatus employed by an electrophotographic image forming apparatus, a process cartridge comprising a charging apparatus, and an image forming apparatus comprising a charging apparatus.

There have been devised a large number of electrophotographic or electrostatic image forming apparatuses. First, referring to FIG. 9, a typical electrophotographic or electrostatic image forming apparatus will be briefly described in terms of the general structure and operation thereof.

As a copy start signal is inputted into the image forming apparatus shown in FIG. 9, the peripheral surface of a photosensitive drum 1001 is charged to a preset potential level by a charging apparatus 1003 of the corona discharge type. Meanwhile, an original placed on an original placement platen 1010 is scanned by a beam of light projected by a unit 1009 made up of an original illumination lamp, a lens array with a short focal point, and a CCD sensor, which are integrally disposed. The beam of light is reflected by the surface of the original, and is focused by the lens array with a short focal point, on the CCD sensor, entering the CCD sensor. The CCD sensor is made up of a light receiving portion, a transferring portion, and an output portion. After the entry into the CCD sensor, the beam of light, or optical signals, are converted by the light receiving portion of the CCD sensor, into electric charges (electrical signals), which are sequentially transferred by the transferring portion, to the output portion, in synchronism with clock pulses. Then, the electric charges are converted in a signal outputting portion, into voltage signals. Then, the voltage signals are amplified and reduced in impedance. Then, they are outputted in the form of analog signals. The thus obtained analog signals are converted into digital signals through one of the known image processing sequences, and are transferred to a printer portion. In the printer portion, an exposing means 1002 made up of LEDs is turned on, emitting a beam of light, or turned off, by the above-mentioned digital signals. As a result, an electrostatic latent image corresponding to the original is formed on the peripheral surface of the photosensitive drum 1001.

This electrostatic latent image is developed by a developing apparatus 1004, which contains particulate toner. As a result, a visible image is formed of toner (which hereinafter will be referred to as a toner image), on the peripheral surface of the photosensitive drum 1001. The toner image is electrostatically transferred onto a sheet of a transfer medium by a transferring apparatus 1007. Then, the sheet of the transfer medium is electrostatically separated from the peripheral surface of the photosensitive drum 1001, and is conveyed to a fixing apparatus 1006, in which the toner image is thermally fixed to the sheet of the recording medium. Then, the sheet of the recording medium is outputted from the image forming apparatus.

After the transfer of the toner image, the peripheral surface of the photosensitive drum 1001 is cleared by a cleaner 1005 of such adherent contaminants as the transfer residual toner, that is, the toner particles remaining on the peripheral surface of the photosensitive drum 1001 after the toner image transfer, etc., and is used for the following image formation; the peripheral surface of the photosensitive drum 1001 is repeatedly used for image formation. Incidentally, the peripheral surface of the photosensitive drum 1001 is exposed as necessary by a pre-exposing means 1008 for eliminating the optical memory resulting from the exposure by the above-mentioned exposing means 1002.

As a photosensitive substance widely used for the above-described image formation process, in other words, a photosensitive substance widely used for an electrophotographic image forming apparatus, there are organic photosensitive substances, and inorganic photosensitive substances such as the photosensitive substance based on amorphous silicon (which hereinafter may be referred to as a-Si-based photosensitive substance). The a-Si photosensitive substance is higher in surface hardness, and it deteriorates very little by repeated usage. Therefore, it is used as the photosensitive material for the electrophotography employed by such an electrophotographic image forming apparatus as a high-speed copying machine, a laser beam printer (LBP), etc.

However, a photosensitive drum is formed by creating silicon plasma with the use of a high frequency wave or microwave, and then, depositing it on the peripheral surface of an aluminum cylinder. Therefore, there is the problem that unless the plasma is uniform, a film of a-Si, which is not uniform in thickness and/or composition in terms of the circumferential direction of the aluminum cylinder, is formed on the peripheral surface of the aluminum cylinder.

Compared to an organic photosensitive member, a photosensitive drum, the photosensitive layer of which is formed of an a-Si-based photosensitive substance, is substantially greater, even in a dark environment, in the amount of potential attenuation which occurs after it is charged. Further, the attenuation of the electrical potential of a photosensitive drum based on an a-Si-based photosensitive substance is exacerbated by the optical memory resulting from an exposing process. Therefore, a pre-exposing means, that is, a means for erasing the optical memory resulting from the exposing process carried out during the preceding rotation of the photosensitive drum, before charging the photosensitive drum, is necessary. As described above, an a-Si-based photosensitive drum is extremely large in the amount by which its electrical potential attenuates between the charging process and developing process; its electrical potential attenuates in the range of 100-200 V. In addition, there is the above-mentioned nonuniformity in the thickness of the photosensitive layer, which makes the electrical potential of the photosensitive drum nonuniform in terms of the circumferential direction of the photosensitive drum. The magnitude of this nonuniformity in electrical potential is in the range of 10-20 V.

A photosensitive drum based on an a-Si-based photosensitive substance which is relatively large in electrostatic capacity is smaller in contrast than an organic photosensitive drum. Therefore, it is affected more by the nonuniformity in electrical potential, being therefore greater in terms of the conspicuousness of the nonuniformity in the image density resulting from the nonuniformity in electrical potential of a photosensitive drum.

As one of the countermeasures for the above-described problem, it is effective to charge a photosensitive drum multiple times. More specifically, the aforementioned phenomenon that the attenuation of electrical potential is exacerbated by optical memory can be eliminated by charging a photosensitive substance multiple times. That is, optical memory is substantially reduced by the first charging process. Therefore, the electrical charge given by the second charging process is attenuated by a much smaller amount. Therefore, the chance of the formation of an image suffering from the occurrence of a ghost image and/or the formation of an image which is nonuniform in density is substantially smaller.

There are the following methods for charging the above-described photosensitive substance: a charging method which uses corona discharge; a charging method which uses an electrically conductive roller to use direct discharge; a charging method which directly injects electrical charge into the surface of a photosensitive substance by creating a contact area of a substantial size between a brush formed of magnetic particles or the like, and the surface of the photosensitive substance; etc. The corona-based charging method and the roller-based charging method rely on electrical discharge. Therefore, they tend to cause byproducts of electrical discharge to adhere to the surface of the photosensitive substance, which is problematic, in particular, if the photosensitive substance is a photosensitive substance based on a-Si. This occurs for the following reason. That is, the surface of an a-Si-based photosensitive substance is extremely hard, and therefore, is less likely to be shaved (worn) by friction. Thus, once by products of electrical discharge adhere to the surface of an a-Si-based photosensitive substance, they are likely to remain thereon. Further, as moisture is adsorbed by the byproducts of electrical discharge having adhered to the surface of an a-Si-based photosensitive substance, in a highly humid environment or the like, the electrical charge on the surface of the photosensitive substance across which an electrostatic latent image has been formed shifts in position along the surface. This shifting of the electrical charge is likely to result in the formation of an image with blurred areas having an appearance of flowing water.

As for the injection-based charging method, in principle, it does not rely on electrical discharge. Instead, it directly injects electrical charge into the surface of a photosensitive substance through the contact area between the charging device and the surface of the photosensitive substance. Therefore, when the injection-based charging method is used, byproducts of electrical discharge are less likely to adhere to the surface of a photosensitive substance. In other words, the injection-based charging method is characterized in that when it is used for image formation, the aforementioned image with blurred areas having the appearance of flowing water is less likely to formed.

In principle, the charging method based on electrical charge injection does not rely on electrical discharge. Therefore, the magnitude of the bias which this method requires to charge an object is equivalent to the desired potential level to which the object is to be charged. Further, it is smaller in the amount by which ozone is generated while an object is charged, and also, in electric power consumption. Therefore, this charging method has attracted increased attention.

As will be evident from the above description of the injection-based charging method, as far as the uniformity with which a photosensitive substance, in particular, an a-Si-based photosensitive substance, is charged, is concerned, charging a photosensitive substance multiple times with the use of the injection-based charging method is very effective.

It should be emphasized here that it is important to employ two charging means for charging multiple times a photosensitive substance, and to employ the injection-based charging means as the charging means employed by the two charging means.

As a charging apparatuses for charging a photosensitive substance multiple times with the use of the injection-based charging method, an injection-based charging apparatus comprising a pair of magnetic brush-based charging devices comes to mind, for example, such as the one shown in FIG. 6.

A magnetic brush-based charging device magnetically confines electrically conductive magnetic particles on a magnet, or the peripheral surface of a sleeve containing a magnet, forming a magnetic brush, which is placed in contact with the peripheral surface of a photosensitive substance. As voltage is applied to the magnet (or sleeve) while the magnet (or sleeve) is stationary, or being rotated, the photosensitive substance begins to be charged.

A magnetic brush-based charging means is superior in the state of contact between the charging means and an object to be charged, being therefore superior in the reliability with which it can charge an object. Therefore, it is a preferable charging means.

At this time, referring to FIGS. 6 and 16, an injection-based charging apparatus which injects electrical charge twice with the use of the magnetic brush-based charging means will be described.

As for the reference symbols in these drawings (which will be referenced later to describe the preferred embodiments of present invention), parenthesized symbols will be referred to in this section of this document.

A charging apparatus 1030 is structured as follows. That is, it comprises: a body of magnetic particles optimized for charging an object; a pair of nonmagnetic, rotatable charge sleeves 1031 and 1032 as magnetic particle bearing members; first and second stationary magnets 1033 and 1034 as non-rotational magnetic field generating members disposed in the hollows of the charge sleeves 1031 and 1032, respectively; and a blade 1037 as a portion for regulating the body of magnetic particles at a point 1035*a* of the body of magnetic particles 35 shown in FIG. 16.

A part of the body of magnetic particles 1035 is shaped in the form of a brush by a magnetic field, and is conveyed by the charge sleeves 1031 and 1032 as the sleeves 1031 and 1032 are rotated. The magnets 1033 and 1034 in the hollows of the sleeves 1031 and 1032 are positioned so that their magnetic poles as the sources of the magnetic fields are located at areas 1033*a* and 1034*a* where the distances between the magnetic poles and the photosensitive drum 1001 are smallest. Therefore, the portion of the body of magnetic particles 1035 is shaped in the form of a broom tip by the magnetic field, coming thereby into contact with the photosensitive drum 1001. The injection of electrical charge into the photosensitive drum 1001 is made through this contact area between the magnetic brush and photosensitive drum 1001.

Hereafter, the charge sleeve, which is on the upstream side, in terms of the direction in which the magnetic particles are conveyed in the areas in which the distances between the charging sleeves and photosensitive drum are smallest, will be called the first charge sleeve, and the charge sleeve on the downstream side will be called the second charge sleeve. The blade 1037 is disposed in the adjacencies of the peripheral surface of the first charge sleeve, and on the upstream side of where the distance between the first charge sleeve and photosensitive drum is smallest, in terms of the magnetic particle conveyance direction.

The stationary magnets 1033 and 1034 in the hollows of the charge sleeves are innovative in the positioning of their magnetic poles. That is, the stationary magnets 1033 and 1034 are positioned, in terms of their circumferential directions, so that the magnetic poles of the stationary magnet 1033, which faces the photosensitive drum, is opposite in polarity to the magnetic pole of the stationary magnet 1033, which faces the photosensitive drum. More specifically, the first stationary magnet is positioned so that one of its S poles faces the photosensitive drum, whereas the second stationary magnet is positioned so that one of its N poles faces the photosensitive drum.

Generally, the magnetic particles 1035 tend to move away from the peripheral surfaces of the first and second charge sleeves 1031 and 1032, in the area in which two magnetic poles identical in polarity, that is, two magnetic poles which repel each other, are located next to each other.

With the first and second stationary magnets positioned so that their magnetic poles are positioned as described above, the magnetic particles 1035 are transferred from the first charge sleeve 1031 onto the peripheral surface of the second charge sleeve 1032, at a first transfer point 1035*c* in FIG. 16, and from the second charge sleeve 1032 onto the peripheral surface of the first charge sleeve 1031, at a second transfer point 1035*e*, without slipping through the gap between the two charge sleeves 1031 and 1032.

The two charge sleeves 1031 and 1032 are both rotated in the direction opposite to the direction in which the photosensitive drum 1001 as an electrophotographic photosensitive member is rotated. As charge voltage is applied to both of the two charge sleeves 1031 and 1032, electrical charge is given to the peripheral surface of the photosensitive drum 1001, charging thereby the peripheral surface of the photosensitive drum 1001 to a potential level which is close to the value of the charge voltage.

The service life of the photosensitive drum 1001 can be extended by reducing the amount of the friction between the magnetic particles 1035 and the photosensitive drum 1001, and the friction between the magnetic particles 1035 and photosensitive drum 1001 can be reduced by reducing the amount of the magnetic particles 1035 coated on the peripheral surfaces of the two charge sleeves 1031 and 1032. Further, the amount of the magnetic particles 1035 coated on the peripheral surfaces of the two sleeves 1031 and 1032 can be reduced by reducing the gap between the blade 1037 and the peripheral surface of the first charge sleeve 1031. However, as the amount of the magnetic particles 1035 coated on the two charge sleeves 1031 and 1032 is reduced, the areas in which the magnetic particles 1035 and photosensitive drum 1001 come into contact with each other are reduced in size, and therefore, the charging apparatus 1030 is reduced in charging performance. This reduction in charging performance of the charging apparatus 1030 can be compensated for by charging the photosensitive drum 1001 multiple times.

The charging apparatus 1030 needs to be precisely positioned relative to the photosensitive drum 1001 in the image forming apparatus, so that a preset amount of a gap is provided between the charging apparatus 1030 and photosensitive drum 1001, for the following reason. That is, the size of the gaps affects how the tip of the magnetic brushes rubs the peripheral surface of the photosensitive drum 1001, the charging performance of the charging apparatus 1030, and the amount by which the photosensitive drum 1001 is shaved, the effluent falling of the magnetic particles, etc. In consideration of the effect of the abovementioned gaps upon the charging performance of the charging apparatus, the amount of shaving of the photosensitive drum 1001, etc., the gap between each of the magnetic particle bearing members and the photosensitive drum 1001 is desired to be set to a value in the range of 200-500 μm, and to be controlled with a tolerance of no more than ±50 μm.

The inventors of the present invention could not find any document useful as a reference regarding the positioning of a magnetic brush-based charging apparatus having multiple charging means. However, there were a few documents regarding the positioning of a developing apparatus comprising multiple developing means, and these documents could be referenced to devise the positioning of the charging apparatus comprising multiple charging means.

In the case of the above-mentioned developing apparatuses comprising multiple developing means, the positions of the developing means and photosensitive member are determined by the positions of the holes with which the front and rear lateral plates for supporting the two development sleeves and single photosensitive drum are provided (for example, Japanese Laid-open Patent Application 06-130799).

There was also a document showing another developing apparatus employing multiple developing sleeves. This developing apparatus is provided with two development sleeves, the lengthwise ends of each of which are fitted with a rotational ring, the diameter of which is greater than that of the development sleeve by an amount equaling the desired preset gap between the development roller and photosensitive drum. Thus, the amount of the gap between the development sleeve and photosensitive drum is determined by the rings as the development sleeve is pressed toward the photosensitive drum. Further, the developing apparatus is provided with a pair of arm-like members, which are pivotable about the rotational axis of the first charge sleeve and determine the size of the gap between the first charge sleeve, and the magnetic particle regulating plate disposed in the adjacencies of the first charge sleeve. As for the second charge sleeve, it is supported by these arm-like members. Further, the arm-like members are kept under the pressure applied by springs, which are different from the springs for pressing the main assembly of the developing apparatus (for example, U.S. Laid-open Patent Application 2002-0054773).

However, if the above-described structures of the developing apparatuses in the abovementioned patent documents are applied to the charging apparatus shown in FIG. 6, various problems occur, which will be described next.

According to Laid-open Japanese Patent Application 06-130799 regarding a developing apparatus, the distances between the two sleeves and single photosensitive drum are set by the positions of the holes of the lateral plates, in which the shafts of the sleeves and photosensitive drum are fitted. In the case of this structural arrangement, the amount of the gap between the two sleeves is determined by the amounts of the gaps between the photosensitive drum and the two sleeves, which are affected by the accuracy in the position of each of the above-mentioned holes.

One of the problems that occur as the above-described structural arrangement is applied to the above-described magnetic brush-based charging apparatus is that the application is likely to cause one or both of the charging sleeves to bend, because in the case of the structural arrangement in which the first and second charge sleeves are supported by the frame of the magnetic brush-based charging apparatus, the amount of the gap between the two charge sleeves is determined by the frame of the charging apparatus. Further, the distances among the centers of the aforementioned holes of the two lateral plates, and the amount of the distance between the two sleeves determined by the frame, are unlikely to be equal. This is why the charge sleeves are likely to be bent if the above-described structural arrangement is applied.

Moreover, generally, the frame of a charging apparatus is mostly formed of resin, and the lateral plates of a charging apparatus are mostly formed of a metallic plate or the like, which usually has a different coefficient of linear expansion from resin.

If the temperature of the charging apparatus deviates from a preset basic temperature, the charge sleeves are likely to be bent by a greater amount, because the material for the frame and the material for the lateral plates are different in the amount by which they thermally expand or contract.

At this time, the problems which occur as the charge sleeves bend will be discussed.

Referring to FIG. 6, as the first charge sleeve 1031 is bent, the distance between first and second charge sleeves 1031 and 1032 becomes nonuniform in terms of the lengthwise direction of the two sleeves. In other words, the distance between the two charge sleeves at a given point in terms of the lengthwise direction of the two sleeves becomes different from that at another point.

Thus, if the first charge roller 1031 is bent, the amount of magnetic particles coated on the peripheral surface of the first charge roller 1031 becomes nonuniform in terms of the lengthwise direction of the roller 1031. In addition, the second charge sleeve 1032 is coated with the magnetic particles 1035 which are transferred from the peripheral surface of the first charge sleeve 1031 by the magnetic poles on the first charge sleeve side, which are opposite in polarity to the magnetic poles on the second charge sleeve side, which faces the magnetic pole on the first charge sleeve side. Therefore, as the amount of magnetic particles 1035 coated on the first charge sleeve 1031 changes, the amount of magnetic particles 1035 coated on the second charge sleeve 1032 also changes. Thus, even if only the first charge sleeve 1031 is bent, the charging performance of the second charge sleeve 1032 is affected. As a result, the charging apparatus 1030 is affected in terms of the overall potential level to which it charges an object.

The above-described deviation in the potential level to which an object is charged by the charging apparatus occurs at the same time as the charging apparatus is assembled, and affects the density level at which an image is formed, in particular, the density level at which a half-tone image is formed, in terms of the direction parallel to the lengthwise direction of the photosensitive drum, as soon as an image forming apparatus employing a charging apparatus suffering the above-described problem is put to use.

The following is a case in which the second charge sleeve 1032 shown in FIG. 6 is bent. FIG. 16 is a drawing depicting the magnetic particles which are flowing at a stable rate, without stagnating. FIG. 17 is a drawing depicting the magnetic particles, some of which are stagnating in the area in which the distance between the second charge sleeve 1032 and photosensitive drum 1001 is reduced toward the area in which the magnetic particles are transferred between the two charge rollers 1031 and 1032.

If the second charge sleeve 1032 bends toward the photosensitive drum 1001 across the lengthwise center portion thereof, the distance between the lengthwise center portion of the second charge sleeve 1032, and the lengthwise center portion of the photosensitive drum 1001 becomes narrower than the preset value, in the area 1035*d* in FIGS. 16 and 17, making it difficult for the magnetic particles to move past the area 1035*d*. As a result, the balance is broken between the amount of magnetic particles transferred onto the second charge sleeve 1032 from the first charge sleeve 1031, and the amount of magnetic particles allowed to move past the area 1035*d*, causing the magnetic particles to stagnate in the first transfer point 1035*c* at which the magnetic particles are transferred from the first charge sleeve 1031 to the second charge sleeve 1032. In particular, if the photosensitive drum 1001 is rotated in the direction opposite to the rotational direction of the charge sleeves, as in the charging apparatus shown in FIG. 6, the magnetic particles are under pressure which, in principle, acts in the direction to push them back, exacerbating the tendency of the magnetic particles to stagnate at the first transfer point 1035*c*, that is, the magnetic particle transfer point on the photosensitive drum side.

As the magnetic particles stagnate at the first transfer point 1035*c*, the rate at which the photosensitive drum 1001 is shaved by the magnetic particles in the adjacencies of the first transfer point 1035*c* substantially increases, changing (reducing) substantially the thickness of the photosensitive layer of the photosensitive drum 1001. As the photosensitive drum 1001 is shaved by a substantial amount, that is, as the photosensitive layer is substantially reduced in thickness, an image formed with the use of the photosensitive drum 1001 will be abnormally higher in density across the areas which correspond to the portions of the photosensitive drum which have been reduced in the thickness of the photosensitive layer, even if the amount of the light with which the areas are exposed remains the same. This suggests that this deviation in the image density in the direction parallel to the lengthwise direction of the photosensitive drum will be a long-term problem.

To discuss a case in which the method, disclosed in U.S. Laid-open Patent Application 2002-0054773, for positioning a developing apparatus is, applied to the charging apparatus shown in FIG. 6, in this case, the amount of the gap between the first charge sleeve and photosensitive drum, and that between the second charge sleeve and photosensitive drum, are both controlled with the use of spacer rings, and therefore, the amount of the gap between each charge roller and photosensitive drum seems to be precisely controlled.

However, if this positioning method is applied to the charging apparatus shown in FIG. 6, the following problems occur.

In the case of this method, the charging apparatus itself is pressed by springs. In principle, therefore, the charging apparatus is likely to shift in position in a direction other than the direction in which the charging apparatus is pressed by the springs.

In other words, the amount of the gap between each charge sleeve and the photosensitive drum can be kept constant, but, the magnetic poles 1033*a* and 1034*a* of the stationary magnets (1033 and 1034, respectively, in FIG. 6), which are in the hollow of the charge sleeves and oppose the photosensitive drum, cannot be stabilized in their position relative to the photosensitive drum, in terms of the circumferential direction of the photosensitive drum. If this structural arrangement is applied to a charging apparatus having two charge sleeves and structured so that the magnetic particles are transferred between the two charge sleeves, the magnetic pole 1033*a* shifts in position. As the magnetic pole 1033*a* shifts in position, the tip of the magnetic brush changes in the position relative to the photosensitive drum 1001. As a result, the point, in terms of the circumferential direction of the photosensitive drum 1001, at which pressure is to be applied to the peripheral surface of the photosensitive drum 1001 by the magnetic particles, changes in position. Therefore, changes occur to the amount by which the magnetic brush moves past the gap between the first charge sleeve 1033 and photosensitive drum 1001. Therefore, changes occur to the amount of magnetic particles coated on the second charge sleeve, as they occurred in the case of the structural arrangement disclosed in the aforementioned Japanese Laid-open Patent Application 06-130799. This affects the charging performance of the second charge sleeve 1032, which in turn affects the overall potential level to which the photosensitive drum 1001 is charged by the charging apparatus 1030.

The above-described deviation in the potential level to which the photosensitive drum 1001 is charged occurs at the time of the assembly of the charging apparatus, and affects the level of density at which an image is formed, in particular, the density level at which a half-tone image is formed, as soon as an image forming apparatus employing a charging apparatus suffering the above-described problem is put to use. This case, however, is different from the case in which the structural arrangement disclosed in Japanese Laid-open Patent Application 06-130799 is applied, in that an image which is nonuniform in its density level, only in terms of the direction parallel to the lengthwise direction of the photosensitive drum 1001 is not formed, but an image which is nonuniform in its density level across the entirety thereof is formed.

Further, if the first charge sleeve deviates in position from the preset point in a direction to move away from the photosensitive drum 1001, the pressure from the magnetic particles is reduced, allowing therefore the amount of magnetic particles slipping through the gap between the first charge sleeve 1031 and photosensitive drum 1001, to increase. As the amount of magnetic particles slipping through the gap between the first charge sleeve 1031 and photosensitive drum 1001 increases, the amount of magnetic particles stagnating in the space 1035*c* surrounded by the peripheral surfaces of the first and second charge sleeves 1031 and 1032 and photosensitive drum 1001 increases. As a result, the amount by which the photosensitive drum 1001 is shaved in the space 1035*c* in which the magnetic particles stagnate becomes substantial. This means that the photosensitive drum 1001 is changed in the thickness of its photosensitive layer as it is in the case in which the structural arrangement disclosed in Japanese Laid-open Patent Application 06-130799 is employed. If the photosensitive drum 1001 is substantially reduced in the thickness of its photosensitive layer due to the shaving of the photosensitive drum 1001 by a substantial amount, an image formed with the use of the photosensitive drum 1001 will be abnormally higher in image density across the areas which correspond to the portions of the photosensitive drum which have been reduced in the thickness of the photosensitive layer, even if the amount of the light with which the areas are exposed remains the same. This suggests that the formation of an image having areas which are abnormally high in image density is a problem of a longer term compared to that resulting from the above described deviation in the potential level to which the photosensitive drum 1001 is to be charged. Also in terms of this change, this structural arrangement is different from that disclosed in Japanese Laid-open Patent Application. That is, the direction in which changes occur is the direction parallel to the lengthwise direction of the photosensitive drum 1001 alone; the deviation in density occurs in all directions of an image.

As described above, it is troublesome to stabilize the amount of magnetic particles coated on the charge sleeves as magnetic particle bearing members in a charging apparatus, by borrowing concepts from the prior art regarding a developing apparatus. It is also troublesome to prevent the magnetic particles from stagnating in the adjacencies of one of the transfer points at which the magnetic particles are transferred between the two charge sleeves as the magnetic particle bearing members.

SUMMARY OF THE INVENTION

According to an aspect of the present invention, there is provided a charging apparatus for electrically charging a member to be charged while magnetic particles in contact with the member to be charged, the apparatus comprising a first magnetic particle carrying member for carrying the magnetic particles; a second magnetic particle carrying member for carrying the magnetic particles, the second magnetic particle carrying member being disposed downstream of the first magnetic particle carrying member with respect to a feeding direction of the magnetic particles at a portion where the first magnetic particle carrying member and the member to be charged are opposed to each other, wherein the magnetic particles are commonly used by the first magnetic particle carrying member and the second magnetic particle carrying member; a regulating portion for regulating the amount of the magnetic particles carried on the first magnetic particle carrying member, at a position upstream of the portion where the first magnetic particle carrying member and the member to be charged are opposed to each other, with respect to the feeding direction of the magnetic particles; a first positioning portion for regulating movement of the first magnetic particle carrying member; a second positioning portion for regulating movement of the second magnetic particle carrying member, wherein the first positioning portion is effective to regulate the first magnetic particle carrying member against its movement in a moving direction of the member to be charged, and wherein the second positioning portion is effective to regulate the second magnetic particle carrying member against its movement in a direction of contact with the member to be charged while permitting movement in the direction of movement of the member to be charged.

According to this aspect of the invention, it is possible to stabilize the amount of magnetic particles coated on a magnetic particle bearing member.

Further, it is possible to prevent an object to be charged, from being shaved by magnetic particles, by preventing magnetic particles from stagnating in the adjacencies of one of the transfer points at which the magnetic particles are transferred between magnetic particle bearing members.

In this aspect of the present invention, the second magnetic particle carrying member may be movable in a direction parallel with a tangent line between the second magnetic particle carrying member and the member to be charged at a position where the second magnetic particle carrying member and the member to be charged are closest to each other.

By doing so, the distance between the second magnetic particle bearing member and an object to be charged can be more precisely maintained.

In the first aspect of the present invention, the second magnetic particle carrying member may be movable so as to maintain a predetermined distance between the second magnetic particle carrying member and the member to be charged.

By doing so, the distance between the second magnetic particle bearing member and an object to be charged can be more precisely maintained.

In the first aspect of the present invention, the apparatus may further comprise an urging member for urging the second magnetic particle carrying member in a direction for preventing the second magnetic particle carrying member from approaching the first magnetic particle carrying member.

By doing so, the magnetic particles can be prevented from stagnating, regardless of the changes in the distance between the first and second magnetic particle bearing members, whether the changes are long-term or momentary.

In the first aspect of the present invention, the first positioning portion and the second positioning portion may be provided on a supporting member for supporting the member to be charged.

By doing so, the distance between each of the multiple magnetic particle bearing members and an object to be charged can be precisely maintained.

In the first aspect of the present invention, the first positioning portion and the second positioning portion may each have a configuration opening in a direction opposite the member to be charged.

By doing so, a charging apparatus can be more easily assembled into an image forming apparatus than according to the prior art.

In the first aspect of the present invention, here, the second magnetic particle carrying member may be provided with an abutting portion for abutment to the member to be charged to maintain a gap between the second magnetic particle carrying member and the member to be charged.

By doing so, the distance between each of multiple magnetic particle bearing members and an object to be charged can be precisely maintained.

In the first aspect of the present invention, the apparatus may further comprise a frame supporting the first magnetic particle carrying member and the second magnetic particle carrying member, and a common driver for the first magnetic particle carrying member and the second magnetic particle carrying member, wherein a direction of a driving force transmitted to the driver from an outside of the frame is toward the member to be charged.

By doing so, each of the multiple magnetic particle bearing members can be kept precisely positioned, even if a large amount of torque is applied to drive the multiple magnetic particle bearing members.

In the first aspect of the present invention, the apparatus may further comprise magnetic field generating means provided in the first magnetic particle carrying member and the magnetic field generating means provided in the second magnetic particle carrying member, wherein magnetic poles of the magnetic field generating means of the first magnetic particle carrying member and the magnetic field generating means of the second magnetic particle carrying member are opposite to each other at a position where the first magnetic particle carrying member and the second magnetic particle carrying member are opposed to each other.

By doing so, it is possible to transfer magnetic particles between two magnetic particle bearing members with the use of a simple method.

In the first aspect of the present invention, the apparatus may further comprise a frame supporting both of the first magnetic particle carrying member and the second magnetic particle carrying member.

By doing so, the first and second magnetic particle bearing members can be supported with a single frame.

In the first aspect of the present invention, the first positioning portion may regulate the first magnetic particle carrying member against movement in a direction of contact to the member to be charged.

By doing so, it is possible to regulate the direction in which the contact point between the first magnetic particle bearing member and an object to be charged shifts.

According to another aspect of the present invention, there is provided a process cartridge detachably mountable to a main assembly of the image forming apparatus, comprising an image bearing member for carrying an electrostatic latent image; a charging device for electrically charging a member to be charged while magnetic particles are in contact with the member to be charged, the charging device including:

a first magnetic particle carrying member for carrying the magnetic particles; a second magnetic particle carrying member for carrying the magnetic particles, the second magnetic particle carrying member being disposed downstream of the first magnetic particle carrying member with respect to a feeding direction of the magnetic particles at a portion where the first magnetic particle carrying member and the member to be charged are opposed to each other, wherein the magnetic particles are commonly used by the first magnetic particle carrying member and the second magnetic particle carrying member;

a regulating portion for regulating an amount of the magnetic particles carried on the first magnetic particle carrying member, at a position upstream of the portion where the first magnetic particle carrying member and the member to be charged are opposed to each other, with respect to the feeding direction of the magnetic particles; a first positioning portion for regulating movement of the first magnetic particle carrying member; a second positioning portion for regulating movement of the second magnetic particle carrying member, wherein the first positioning portion is effective to regulate the first magnetic particle carrying member against its movement in a moving direction of the member to be charged, and wherein the second positioning portion is effective to regulate the second magnetic particle carrying member against its movement in a direction of contact to the member to be charged while permitting movement in the direction of movement of the member to be charged.

According to this aspect of the present invention, it is possible to provide an excellent image with the use of a process cartridge equipped with a charging apparatus stable in the amount by which magnetic particles are coated.

According to a further aspect of the present invention, there is provided an image forming apparatus comprising an image bearing member for carrying an electrostatic latent image; a charging device for electrically charging a member to be charged while magnetic particles are in contact with the member to be charged, the charging device including:

a first magnetic particle carrying member for carrying the magnetic particles; a second magnetic particle carrying member for carrying the magnetic particles, the second magnetic particle carrying member being disposed downstream of the first magnetic particle carrying member with respect to a feeding direction of the magnetic particles at a portion where the first magnetic particle carrying member and the member to be charged are opposed to each other, wherein the magnetic particles are commonly used by the first magnetic particle carrying member and the second magnetic particle carrying member; a regulating portion for regulating the amount of the magnetic particles carried on the first magnetic particle carrying member, at a position upstream of the portion where the first magnetic particle carrying member and the member to be charged are opposed to each other, with respect to the feeding direction of the magnetic particles; a first positioning portion for regulating movement of the first magnetic particle carrying member; a second positioning portion for regulating movement of said second magnetic particle carrying member, wherein the first positioning portion is effective to regulate the first magnetic particle carrying member against its movement in a moving direction of the member to be charged, and wherein said second positioning portion is effective to regulate the second magnetic particle carrying member against its movement in a direction of contact to the member to be charged while permitting movement in the direction of movement of the member to be charged.

According this aspect of the present invention, it is possible to provide an excellent image with the use of an image forming apparatus equipped with a charging apparatus stable in the amount of coated magnetic particles.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to FIGS. 1-8 and 16.

Embodiment 1

Figure 1:
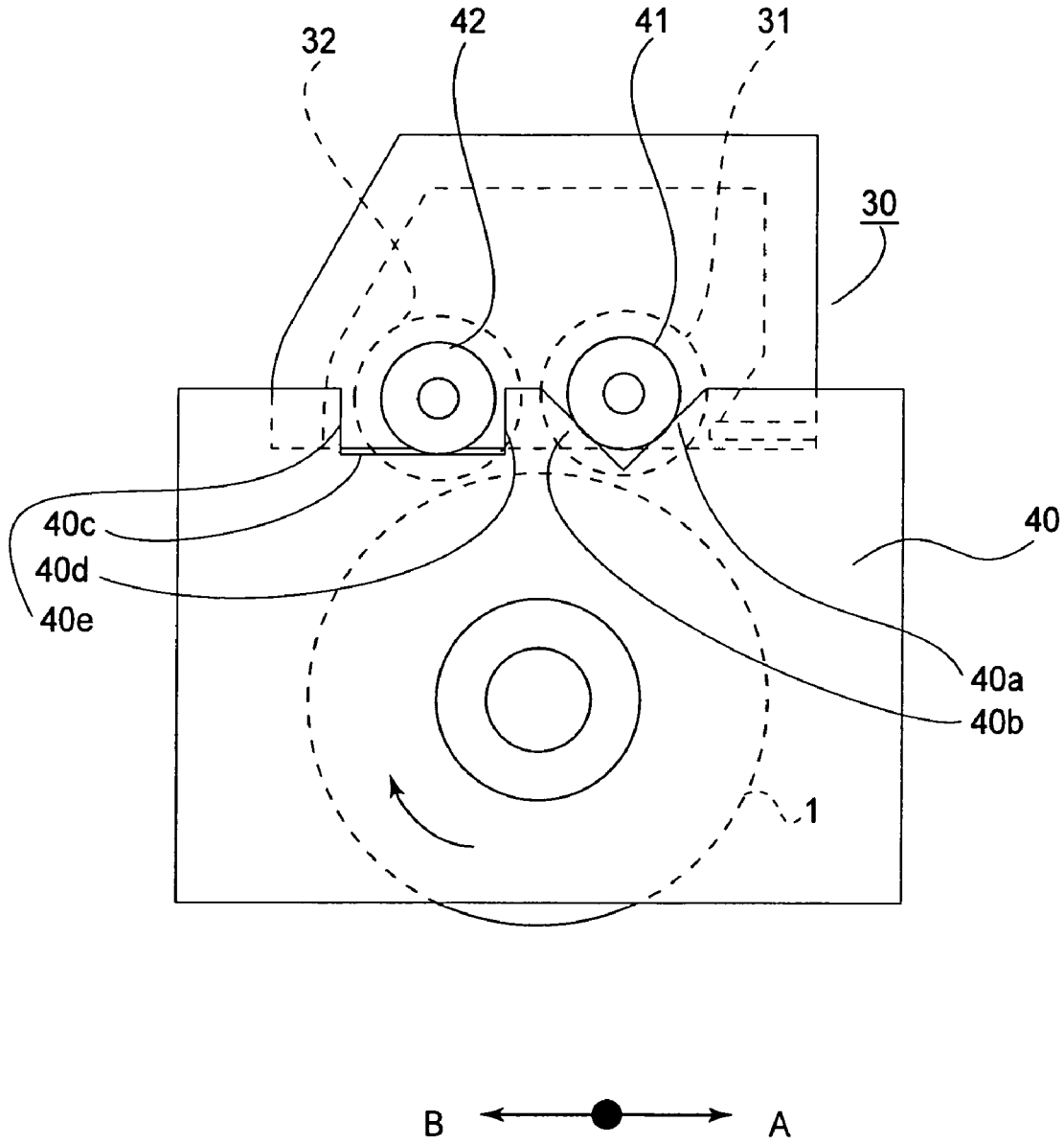
FIG. 1 is a drawing showing the positioning portion in the first embodiment of the present invention.
Figure 2:
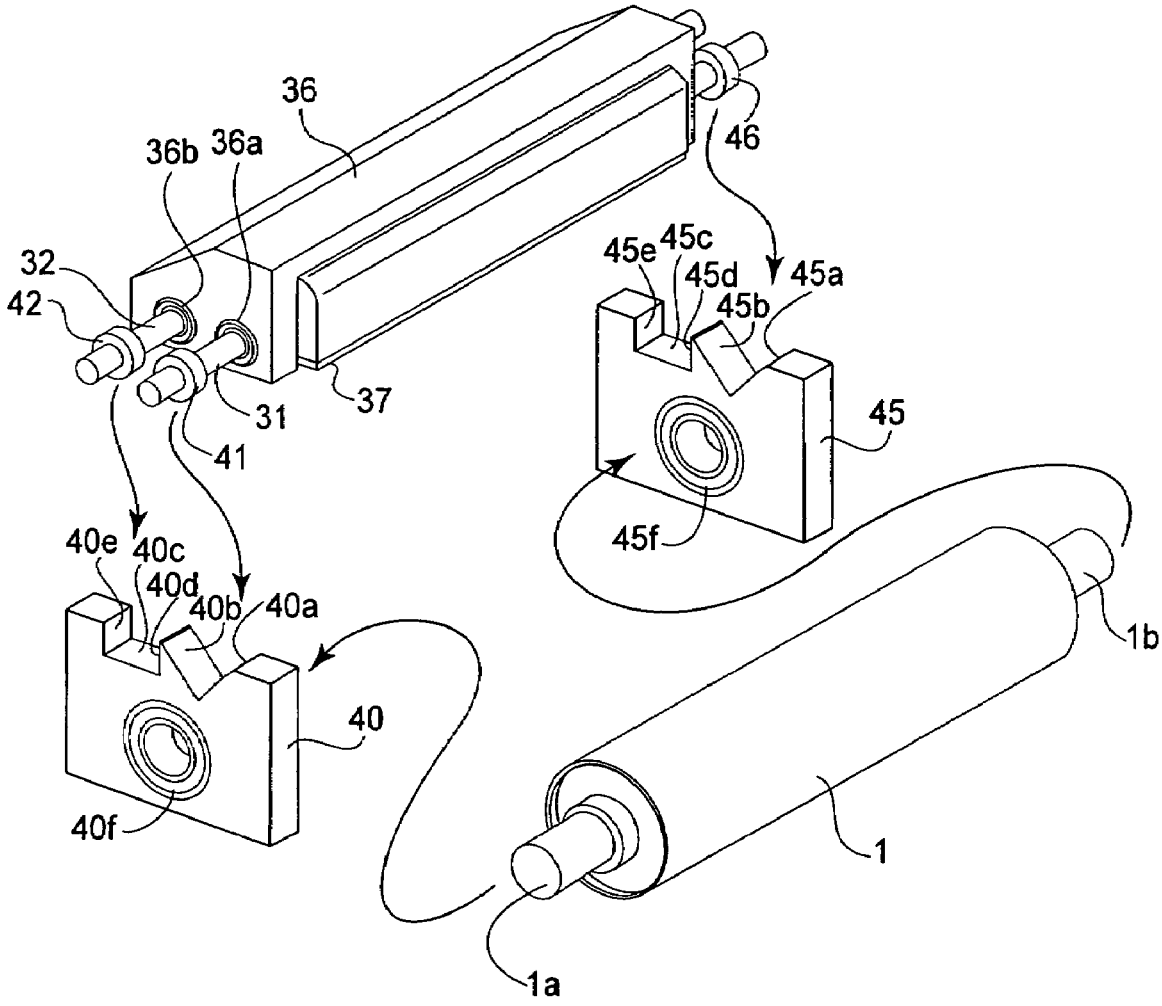
FIG. 2 is a drawing showing the state of the charging apparatus in the first embodiment prior to its assembly.
Figure 3:
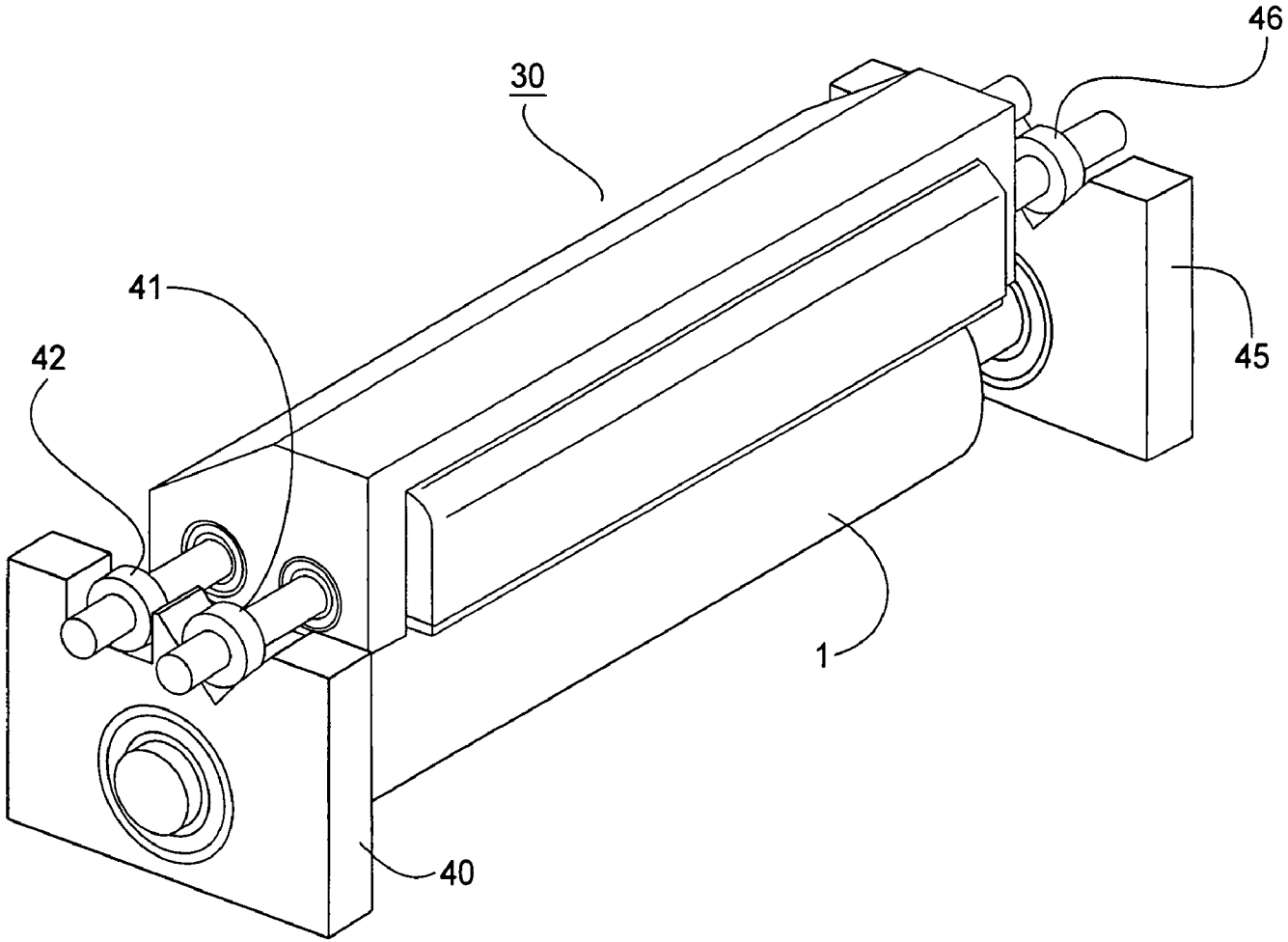
FIG. 3 is a drawing showing the state of the charging apparatus in the first embodiment after its assembly.
Figure 4:
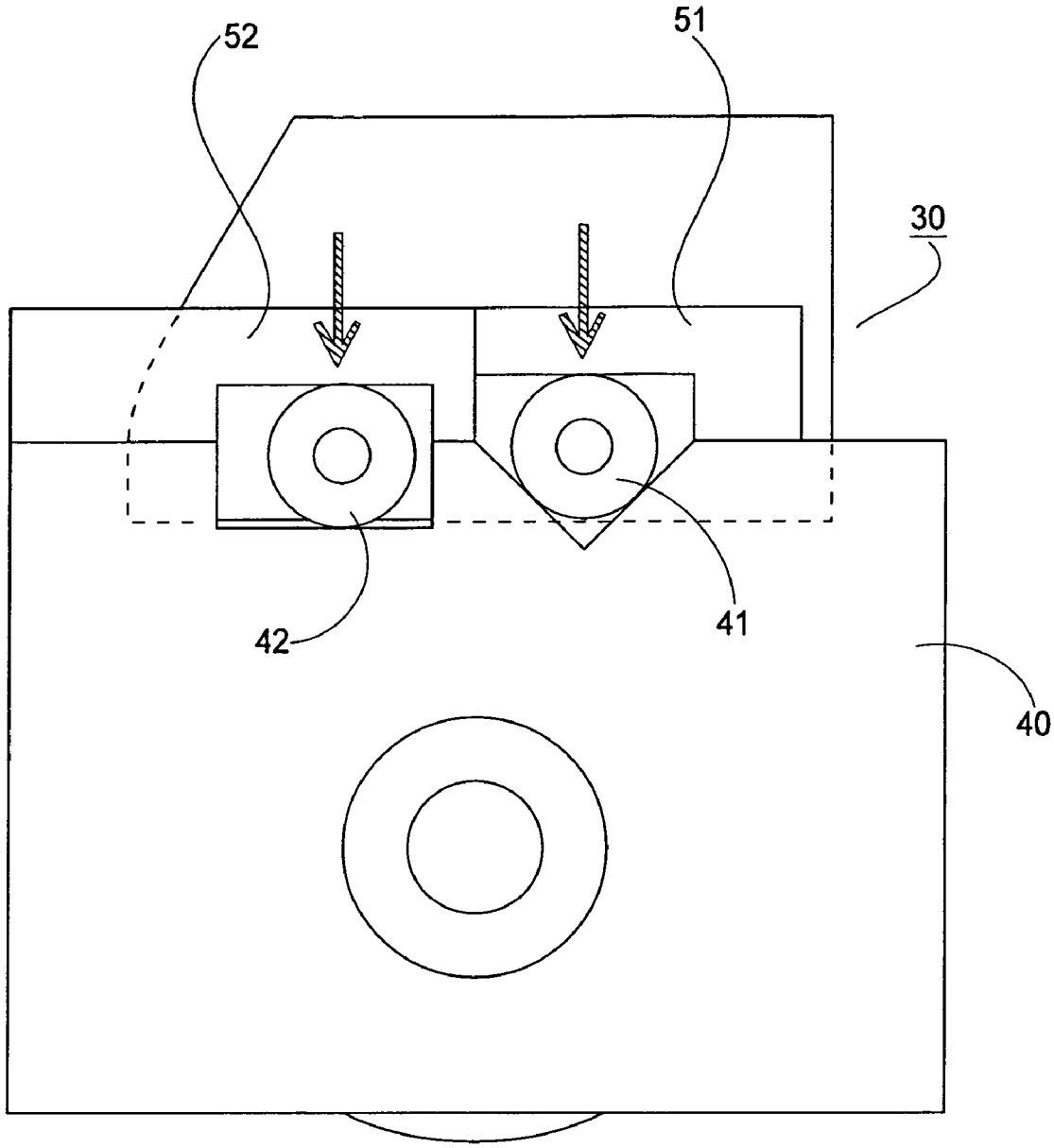
FIG. 4 is a drawing showing the pressing means in the first embodiment.
Figure 5:
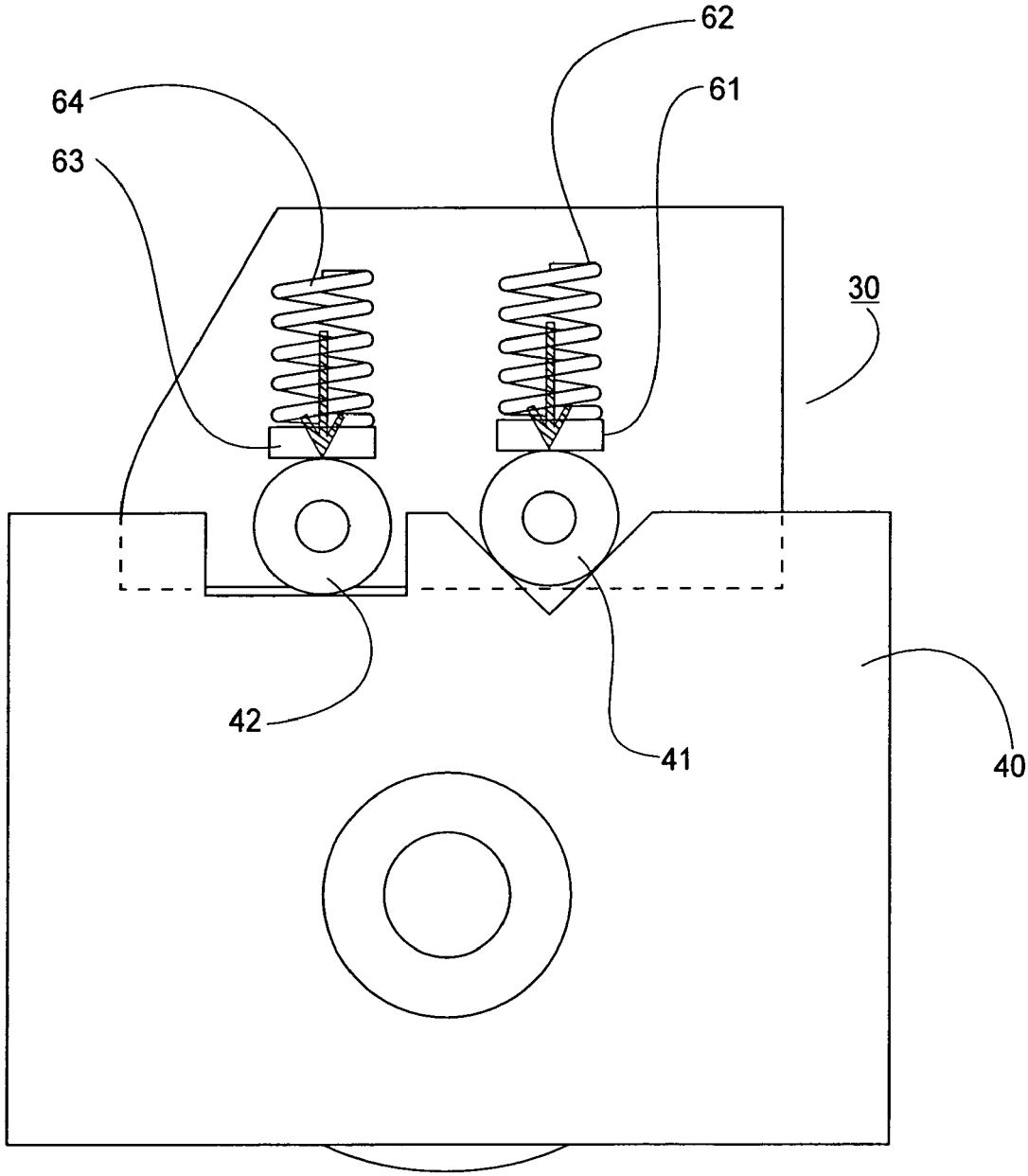
FIG. 5 is a drawing showing the pressing means in the first embodiment, which is different from the pressing means shown in FIG. 4.
Figure 6:
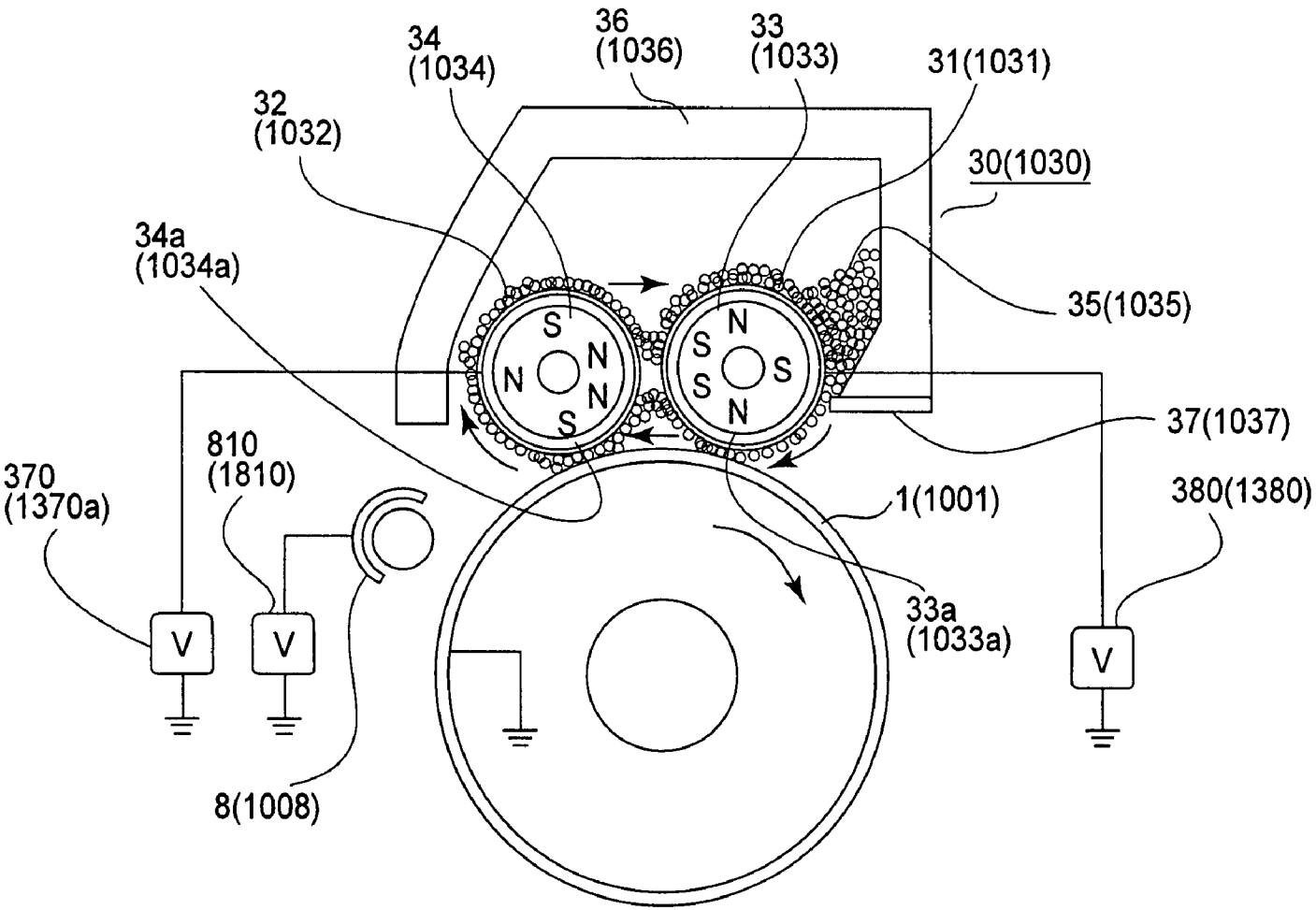
FIG. 6 is a drawing showing the flow of magnetic particles.
Figure 7:
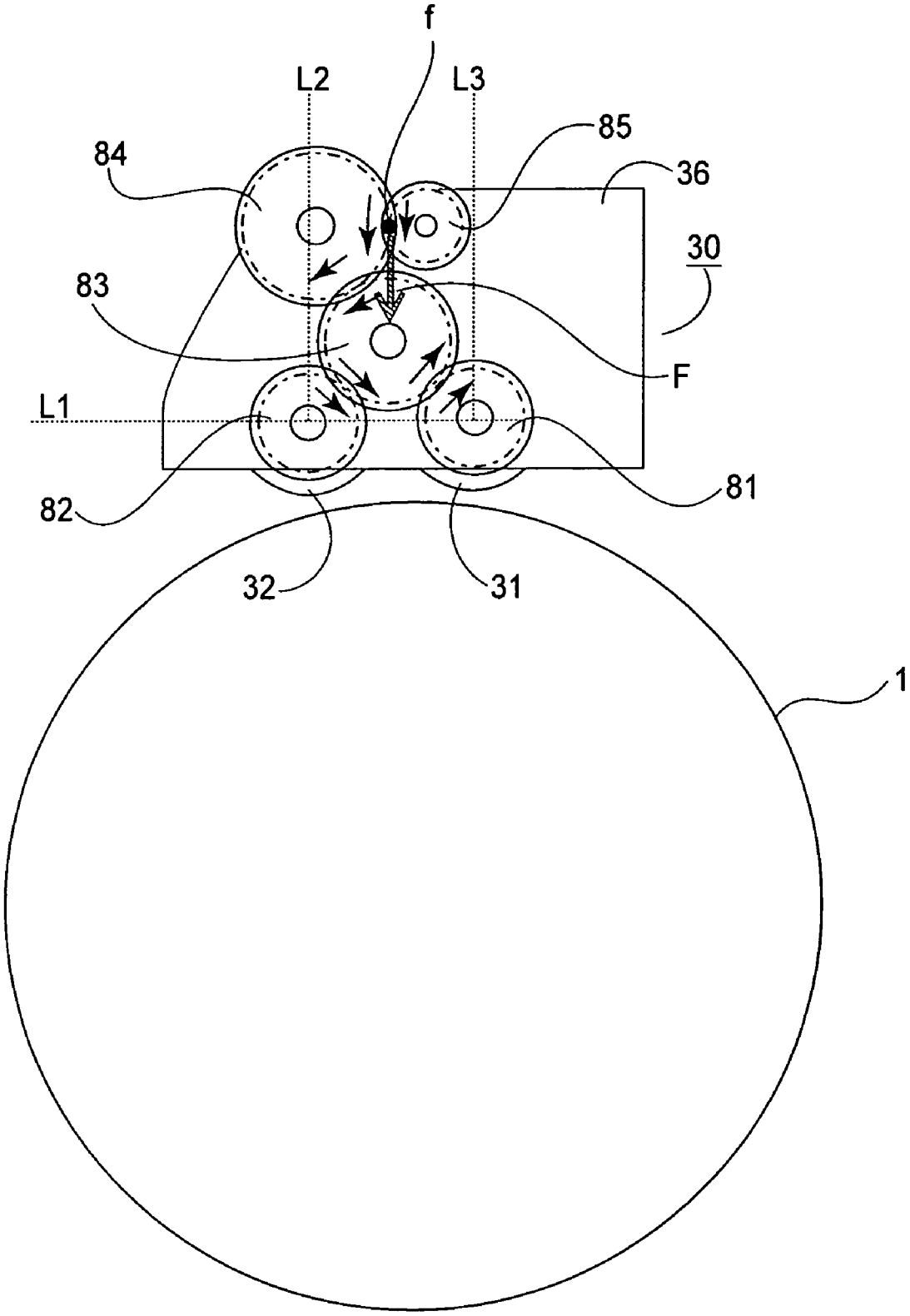
FIG. 7 is a drawing showing the driving system in the first embodiment.
Figure 8:
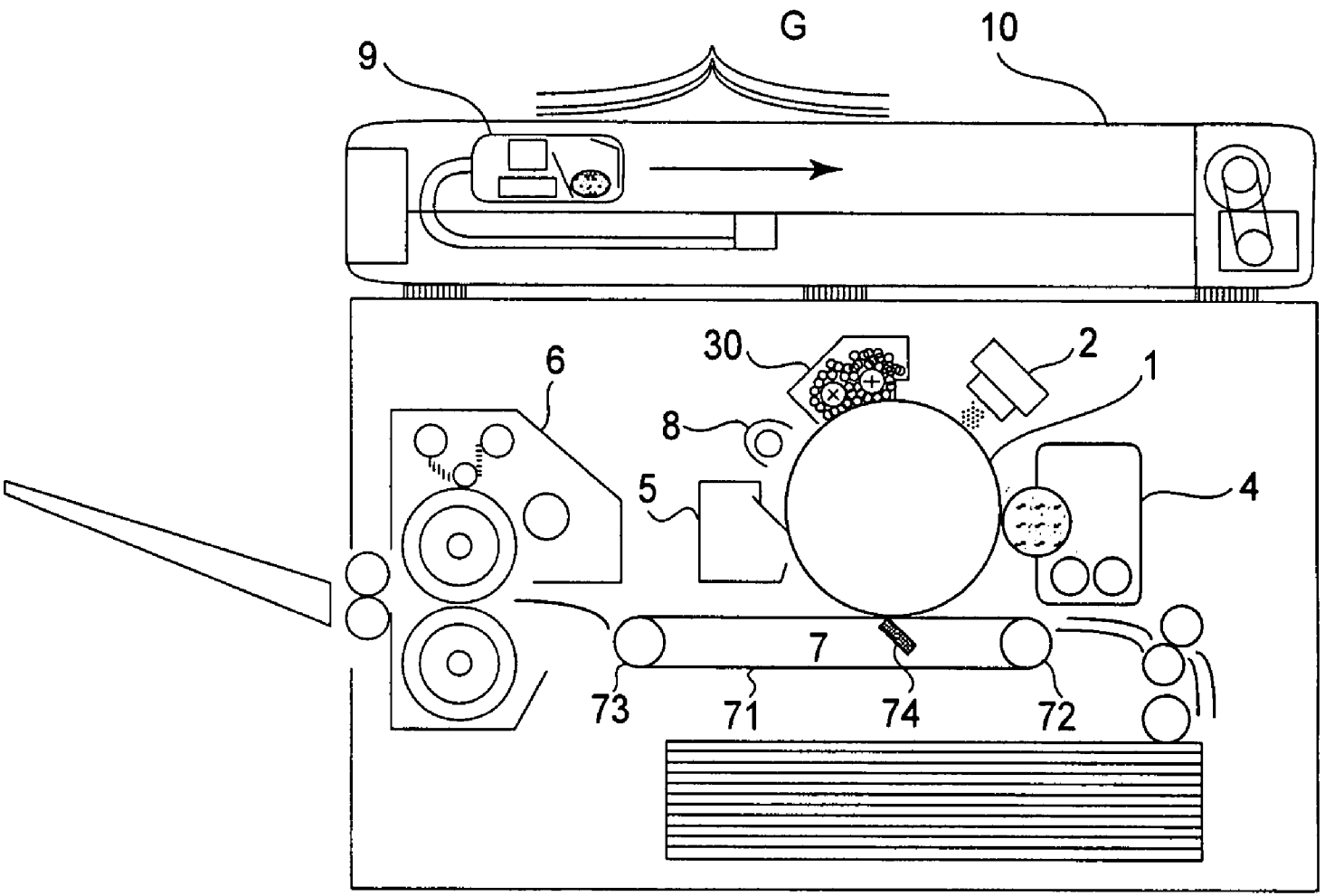
FIG. 8 is a drawing showing the image forming apparatus in accordance with the present invention.
Figure 9:
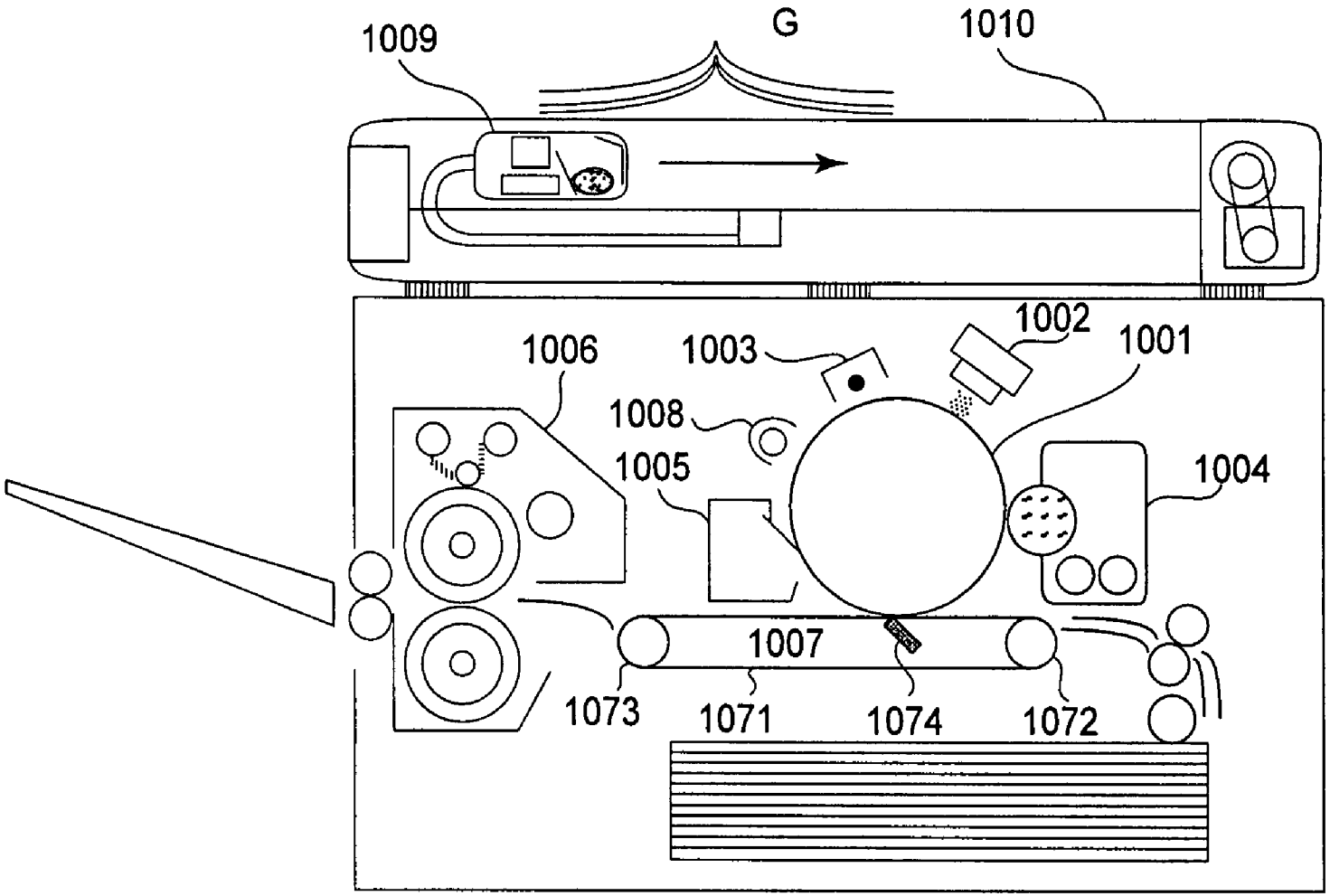
FIG. 9 is a drawing showing a typical image forming apparatus in accordance with the prior art.
Figure 16:
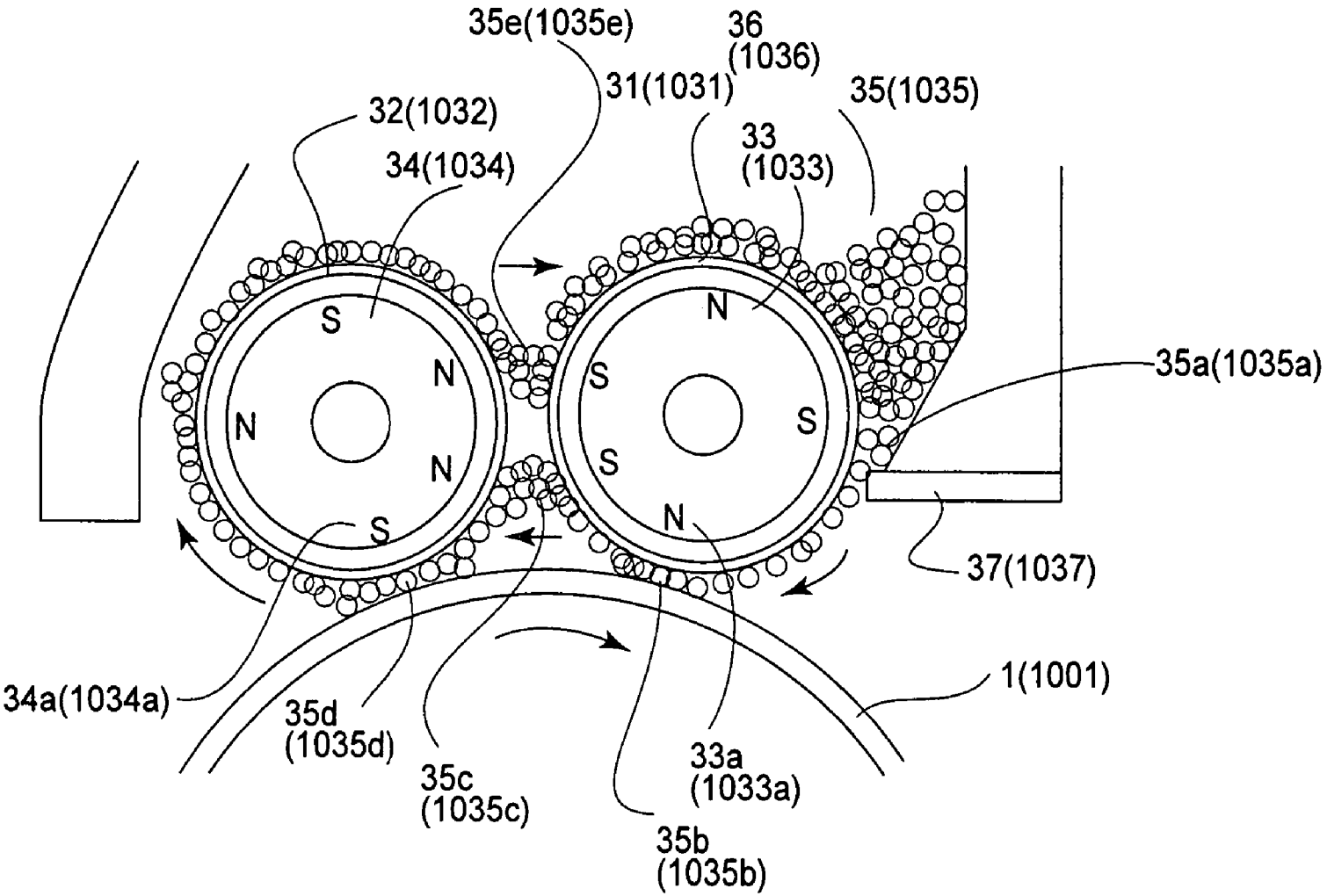
FIG. 16 is a drawing showing the flow of magnetic particles.
Figure 17:
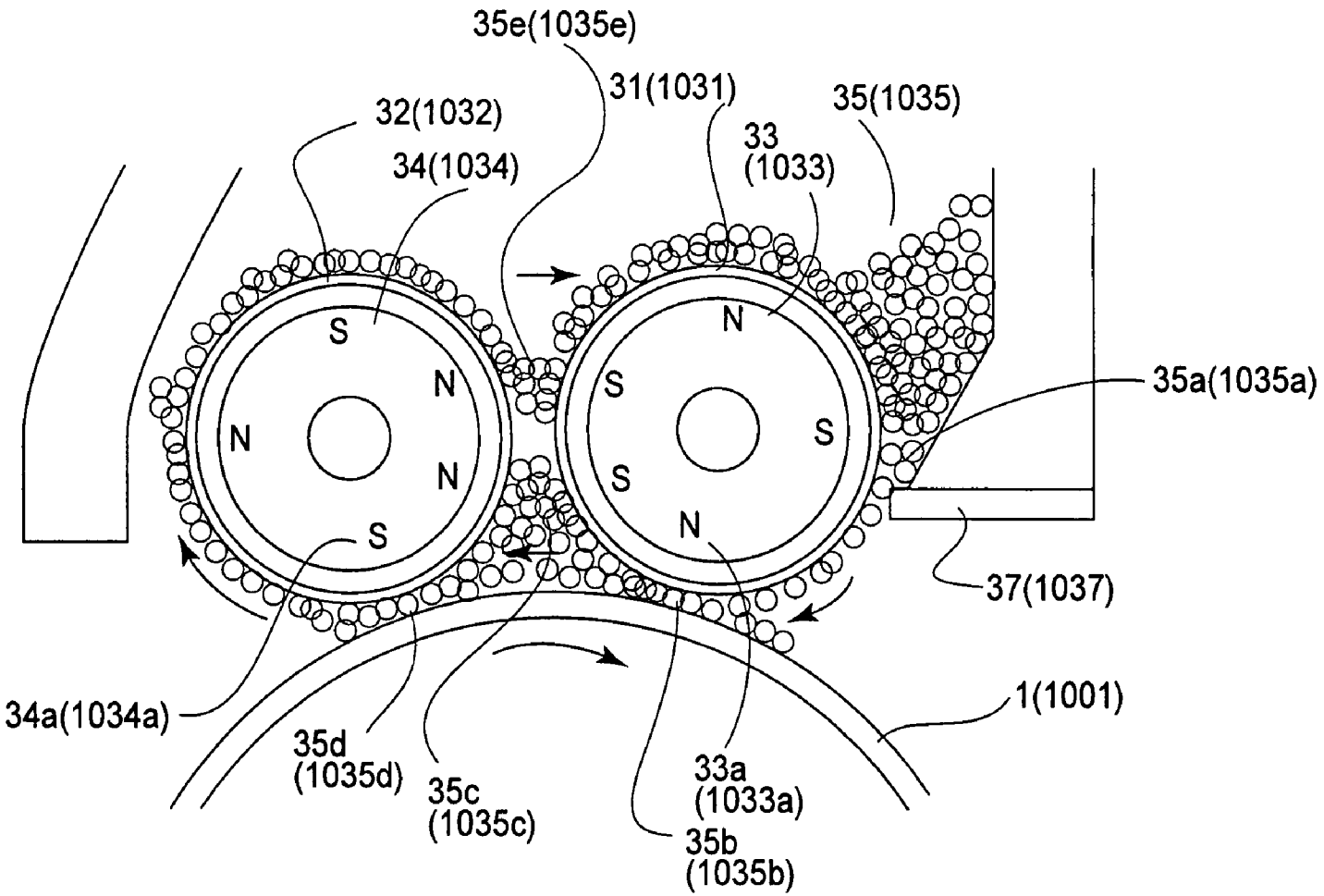
FIG. 17 is a drawing showing the flow of magnetic particles.

FIG. 1 is a drawing showing the structure for positioning the first and second charge sleeves of the charging apparatus in accordance with the present invention. FIG. 2 is a drawing showing the state of the unit comprising the charging apparatus and a photosensitive drum as an electrophotographic photosensitive member, prior to its assembly. FIG. 3 is a drawing showing the state of unit comprising the charging apparatus and a photosensitive drum after its assembly. FIG. 4 is a drawing showing the means for pressing the first and second charge sleeves on the positioning portion. FIG. 5 is a drawing showing the pressing means different from the one shown in FIG. 4. FIGS. 6 and 16 are drawings showing the behavior of the magnetic particles in the charging apparatus. The structure shown in FIGS. 6 and 16 is the structure of the charging apparatus, in accordance with the background technologies, which employs two magnetic brush-based charging devices. However, the basic behavior of magnetic particles in this embodiment is the same as that in a charging apparatus in accordance with the background art. Therefore, the same drawings, that is, FIGS. 6 and 16, will be referenced to describe this embodiment, except that the reference symbols used for describing this embodiment will be not parenthesized; reference symbols such as 1 and 31 having no parenthesis will be used. FIG. 7 is a drawing of a gear train for driving the charge sleeves, and showing the structure thereof. FIG. 8 is a drawing showing an image forming apparatus equipped with the charging apparatus in this embodiment.

The gist of the structure and charging function of the charging apparatus, in this embodiment, employing two magnetic brush-based charging devices is the same as those of the charging apparatus described in the background technology section of this specification, and therefore, will not be described here.

Also, the image forming apparatus shown in FIG. 8 is an image forming apparatus equipped with one of the magnetic brush-based charging apparatuses in accordance with the present invention, and its basic operation is the same as that of the charging apparatus in the background section of this specification. Therefore, it will not be described here.

First, referring to FIGS. 1, 2, 3, 4, and 5, the method for positioning the first and second charge sleeves of the charging apparatus in this embodiment of the present invention will be described.

Referring to FIGS. 1, 2, and 3, designated by a reference symbol 1 is an electrophotographic photosensitive member, more specifically, an a-Si-based photosensitive drum, as an image bearing member, which is an object to be charged, and the inherent polarity of which is negative. Designated by a reference symbol 30 is a charging apparatus which employs two magnetic brush-based charging means, and which charges an object by directly injecting electrical charge into the object. Designated by reference symbols 31 and 32 are first and second magnetic particle bearing members, respectively. Designated by reference symbols 40 and 45 are positioning members for precisely positioning the photosensitive drum 1 and first and second charge sleeves, by their lengthwise ends, at the same time, and also, for holding the photosensitive drum 1. Designated by reference symbols 41 and 46 are positioning rings fitted around the lengthwise end portions of the first charge sleeve, one for one. Designated by a reference symbol 42 is a positioning ring fitted around one of the lengthwise end portions of the second charge sleeve. The charging apparatus 30 in this embodiment is provided with the positioning member 40, which is located within the charging apparatus 30. To the positioning member 40, not only is the photosensitive drum 1 attachable, but also, a developing apparatus 4, a cleaning apparatus 5, a pre-exposing apparatus, etc., which are not shown in FIGS. 1, 2, and 3, but, are shown in FIG. 8, are attachable. These components are integrally disposed in a cartridge, making up thereby a so-called process cartridge.

The rotational direction of the photosensitive drum 1 is the direction indicated by an arcuate arrow mark in FIG. 1. Designated by reference symbols 40*a* and 45*a* are the portions of the positioning members 40 and 45, which regulate the positional deviation of the first charge sleeve in the downstream direction in terms of the rotational direction of the photosensitive drum 1. Designated by reference symbol 40*b* and 45*b* are the portions of the positioning members 40 and 45, which regulate the positional deviation of the first charge sleeve in the upstream direction in terms of the shifting direction of the photosensitive drum 1. In other words, the positional deviation of the first charge sleeve in the direction parallel to the movement of the peripheral surface of the photosensitive 1 is regulated by the first positioning portions 40*a*, 45*a*, 40*b*, and 45*b*. Therefore, it does not occur that the first charge sleeve 31 shifts in position in the direction to come closer to the second charge sleeve 32. Further, the first positioning portions 40*a*, 45*a*, 40*b*, and 45*b* also regulate the positional deviation of the first charge roller 31 in the direction to move closer to the photosensitive drum 1. Here, the direction parallel to the moving direction of the peripheral surface of the photosensitive drum 1 means one of the directions in which the force applied to rotate the charge sleeves acts. The shifting of the charging sleeves in the direction of the contact point means the shifting of the charge sleeves in the direction parallel to the normal line of the peripheral surface of the photosensitive drum at the contact.

Designated by reference symbols 40*c* and 45*c* are the positioning portions of the positioning members 40 and 45, which control the distance between the peripheral surface of the second charge sleeve and the peripheral surface of the photosensitive drum 1, in other words, the portions which control the shifting of the second charge sleeve toward the contact point between the second charge sleeve and photosensitive drum. Designated by reference symbols 40*d* and 45*d* are stopper portions which are for keeping the distance from the second charge sleeve 32 to the first charge sleeve 31 within a preset range, and which prevent the second charge sleeve 32 from moving no less than a preset distance toward the first charge sleeve 31. Designated by reference symbols 40*e* and 45*e* are the stopper portions which are for keeping the distance from the second charge sleeve 32 to the first charge sleeve 31 within a preset range, and which prevent the second charge sleeve 32 from moving no less than a preset distance from the first charge sleeve 31. Designated by reference symbols 40*f* and 45*f* are bearing portions by which the photosensitive drum is supported. In other words, the movement of the second charge sleeve toward, or away from, the photosensitive drum 1 is controlled by the second positioning portions 40*d*, 45*d*, 40*e*, and 45*f*.

Next, referring to FIGS. 4 and 5, designated by reference symbols 51 and 52 are pressing members for pressing the positioning ring 41 fitted around one of the lengthwise end portions of the first charge sleeve 31, and the positioning ring 42 fitted around one of the lengthwise end portions of the second charge sleeve 32, upon the positioning portion of the positioning member 40. Designated by reference symbols 61 and 63 are pressing members, different from the pressing members 51 and 52, for pressing the positioning ring 41 fitted around one of the lengthwise end portions of the first charge sleeve 31, and the positioning ring 42 fitted around one of the lengthwise end portions of the second charge sleeve 32, upon the positioning portion of the positioning member 40. As the means for providing the pressing force, compression springs 62 and 64 are provided. As is evident from the drawings, the openings of the positioning portions of the positioning members face the direction opposite to the direction in which the photosensitive drum 1 is located. Therefore, the process of attaching the above-mentioned components to the positioning members can be carried out from one direction. Further, all that has to be done to attach the charging apparatus to the main assembly of an image forming apparatus is to mount the unit and fasten the pressing members. Therefore, this structural arrangement is superior in ease of assembly to the structural arrangement, disclosed in Japanese Laid-open Patent Application 06-130799, in which the distance between the two sleeves is controlled by controlling the position of the sleeve supporting holes of the lateral plates.

Next, the operation of the charging apparatus in this embodiment will be described.

Referring to FIG. 2, the first and second charge sleeves 31 and 32 are supported by the bearing portions 36*a* and 36*b* of the frame 36.

Referring to FIG. 6, the direction in which the magnetic particles are conveyed is opposite to the rotational direction of the photosensitive drum 1. Referring to FIG. 16, the magnetic particles on the first charge sleeve 31 are controlled by a nonmagnetic or magnetic blade 37, in an amount by which they are allowed to remain on the first charge sleeve 31, at a point on the upstream side of the point 35*b* at which the distance between the photosensitive drum 1 and first charge sleeve 31 is smallest, in terms of the magnetic particle conveyance direction. On the other hand, the second charge sleeve 32 receives magnetic particles from the first charge sleeve 31; the magnetic particles on the first charge sleeve 31 are transferred, in the area 35*c*, to the second charge sleeve 32 by the magnetic poles of the stationary magnet in the first charge sleeve 31, and the magnetic poles of the stationary magnet in the second charge sleeve 32 which are opposite in polarity to the magnetic poles of the stationary magnet in the first charge sleeve 31. The charging apparatus is structured so that the point at which magnetic particles are transferred from the first charge sleeve 31 to the second charge sleeve 32 is on the photosensitive drum side of the area 35*c*.

Next, referring to FIG. 2, the method for attaching the charging apparatus 30 to the supporting member 40 will be described. The first charge sleeve 31 is positioned so that the rings 41 and 46 fitted around the lengthwise end portions of the first charge sleeve 31, one for one, are rested on the positioning portions 40*a* and 45*a*. As for the second charge sleeve 32, it is positioned so that the ring 42 fitted around one of the lengthwise end portions of the second charge sleeve 32, and the unshown ring fitted around the other lengthwise end portion of the second charge sleeve 32, are rested on the positioning portions 40*c* and 45*c*.

Next, referring to FIG. 4, the above-described four rings are kept pressed by the pressing members 51 and 52, and the pressing members located on the opposite side of the charging apparatus 30 from the pressing members 51 and 52, so that the four rings are kept perfectly in contact with the positioning surfaces of the positioning members. The force for pressing the four rings is generated by fastening the pressing members to the positioning members 40 and 45 with the use of unshown screws or the like. As the pressing members are fastened to the positioning members 40 and 45, not only is the first charge sleeve 31 precisely positioned, but also, it is prevented from moving in the downstream direction A and upstream direction B, in terms of the rotational direction of the photosensitive drum 1, by the positioning portions 40*a*, 40*b*, 45*a*, and 45*b*. The positioning surfaces of the positioning portions 40*c* and 45*c* precisely position the second charge sleeve 32 while preventing the second charge sleeve 32 from moving toward the photosensitive drum 1. However, the positioning portions 40*c* and 45*c* are shaped to allow the second charge sleeve 32 to move slightly in the direction parallel to the moving direction of the peripheral surface of the photosensitive drum 1; the second charge sleeve 32 is allowed to move in the direction parallel to the moving direction of the peripheral surface of the photosensitive drum 1. In the case of such a structural arrangement as the one disclosed in Japanese Laid-open Patent Application 06-130799, in which the distance between the two sleeves is determined by the position of the holes of the lateral plates, the distance between the first and second charge sleeves 31 and 32 is determined by the frame 36. In comparison, in the case of the structural arrangement in this embodiment, even if the distance between the two sleeves attached to the frame 36, that is, the distance between the bearings supporting the first charge sleeve 31 and the bearings supporting the second charge sleeve 32, becomes slightly different from the preset value, such a discrepancy can be tolerated; in other words, it does not occur that the very process of assembling the charging apparatus bends one of the two sleeves.

The following are the results of the comparison between the structure of the charging apparatus in this embodiment, and that of the charging apparatus to which the structural arrangement of the developing apparatus in accordance with the prior art was adapted, and which was described in the background section of this specification.

As one of the effects of this embodiment, the changes in the behavior of magnetic particles, which occur in response to the thermal deformation of the frame 36, will be described.

Generally, there are many heat sources, more specifically, an exposing apparatus, a driver element for controlling the light emission of the exposing apparatus, a heater for stabilizing the potential level to which the photosensitive drum 1 is charged, a fixing apparatus, etc., in an electrophotographic image forming apparatus. Thus, the ambient temperature of the charging apparatus 30 sometimes deviates from a preset level. If the ambient temperature of the charging apparatus 30 deviates upward from the preset level, the frame 36 expands by the amount proportional to the difference between the increased ambient temperature and preset one, increasing thereby the distance between the first and second charge sleeves (specific value will be given later). As for the materials of which the supporting member 40 and frame 36 are formed, generally, the supporting member 40 is formed of a metallic substance, whereas the frame 36 is formed of resinous substance. To discuss what occurs as the ambient temperature of the charging apparatus, the supporting member 40 and frame 36, whose coefficient of thermal expansion are different, rises, if the structural arrangement, which is disclosed in Japanese Laid-open Patent Application 06-130799, and which has been described in the background section of this specification, is applied to a charging apparatus, the difference in co-efficient of thermal expansion between the lateral plates and frame cannot be absorbed, causing at least one of the first and second charge sleeves to bend.

In the case of the structural arrangement in this embodiment, the first charge sleeve 31 is prevented from moving in the directions indicated by arrow marks A and B in the drawing, whereas the second charge sleeve 32 is allowed to move in the direction indicated by the arrow mark B. Thus, even if the ambient temperature deviates upward from the preset level, the sleeves are not bent. The problems resulting from the above-mentioned bending of the sleeves are as have been described in the section of this specification regarding the problems to be solved by the present invention.

If the first charge sleeve 31 shown in FIG. 6 is bent, the amount of magnetic particles 35 moving through the gap between the first charge sleeve 31 and the photosensitive drum 1 changes. As a result, the amount of magnetic particles 35 coated on the second charge sleeve 32 changes. In other words, even if only the distance between the first charge sleeve 31 and photosensitive drum 1 changes, the charging performance of the second charge sleeve 32 is affected. This changes the overall potential level to which an object is charged by the charging apparatus 30. This deviation in potential level is present immediately after the assembly of the charging apparatus, and affects an image forming apparatus in image density, in particular, in the image density of halftone areas, as soon as the image forming apparatus is put to use.

If the second charge sleeve 32 shown in FIG. 6 is bent, the magnetic particles stagnate in the area 35*c*, in FIG. 16, where magnetic particles are transferred from the first charge sleeve 31 to the second charge sleeve 32. As magnetic particles stagnate there, the amount by which the photosensitive drum 1 is shaved by the magnetic particles substantially increases. This nonuniformly changes (reduces) the thickness of the photosensitive layer of the photosensitive drum 1. With the thickness of the photosensitive layer nonuniformly reduced, the portions of the photosensitive drum 1 having been reduced in thickness increase in the absolute value of the potential level to which their potential will attenuate as they are exposed, if the amount of the exposure light is kept the same. As a result, the image forming apparatus will form an image, which is higher in density across the portions which correspond to the portions of the photosensitive layer which has been reduced in thickness. This change in the potential level to which the potential of the charged peripheral surface of the photosensitive drum 1 attenuates as it is exposed is different from the above-described change in the potential level to which the peripheral surface of the photosensitive drum 1 is charged, and is different from the above-described change in the potential level, in that it is long-term, and therefore, the resultant formation of an image suffering from the deviation in image density by the image forming apparatus is long-term.

On the other hand, if the ambient temperature becomes lower than the preset level, the frame 36 contracts, causing thereby the charge sleeves to bend. Obviously, this embodiment is also effective as a countermeasure for the bending of the charge sleeves attributable to this contraction of the frame 36.

Regarding the movement of the second charge sleeve 32, it is preferable that the second charge sleeve 32 is allowed to move within a preset range, in order to stabilize the transfer of magnetic particles between the first charge sleeve 31 and the second charge sleeve 32. Even if the two charge sleeves are allowed to come close to each other, it is desired that control is executed to keep the distance between the two sleeves within the range of 300-500 μm.

If the distance between the two sleeves becomes very large or very small, the transfer of magnetic particles between the two sleeves becomes unstable. Thus, the supporting member 40 is provided with the stopper portions 40*d* and 40*e*, as shown in FIGS. 1 and 2, for preventing the distance between the two sleeves from becoming very large or very small, limiting thereby the range in which the second charge sleeve 32 is allowed to move. More specifically, the stopper portion 40*d* prevents the distance between the two sleeves from becoming too small, whereas the stopper portion 40*e* prevents the distance between the two sleeves from becoming too large. With the provision of these stopper portions, the second charge sleeve 32 is prevented from excessively shifting in position. Therefore, the transfer of magnetic particles remains stable.

The amount of magnetic particles coated on the first charge sleeve 31 is regulated by the regulation blade 37, and the first charge sleeve is prevented from moving toward the photosensitive drum. Therefore, the positions of the magnetic poles of the magnet in the hollow of the first charge sleeve relative to the photosensitive drum do not change. Therefore, magnetic particles are reliably supplied to the nip between the first charge sleeve and photosensitive drum, making it possible for the first charge sleeve to satisfactorily charge the photosensitive drum. As for the second charge sleeve to which magnetic particles are transferred from the first charge sleeve, it is slightly moved by the thermal expansion of the frame 36, in the direction parallel to the moving direction of the peripheral surface of the photosensitive drum. However, it is supplied with a stable amount of magnetic particles, by the first charge sleeve, and therefore, the slight movement of the second charge sleeve does not affect the charging performance of the second charge sleeve.

Next, the configuration and operation of the charging apparatus in this embodiment will be described in more detail with reference to concrete values. The frame is formed of ABS resin which has a coefficient of linear thermal expansion of $8.0\times10^{-5}$/° C. The first and second charge sleeves are 16 mm in diameter, and the distance between the two charge sleeves is 1 mm. With the coefficient of linear thermal expansion of the material for the frame being as stated above, as the ambient temperature rises 30° C. from the preset level, the distance between the two sleeves changes as much as roughly 70 μm. Here, the reason why it is said that the distance between the two sleeves changes as much as roughly 70 μm is that there is a difference in displacement between the portion of the bearing portion 36*b* for holding the second charging sleeve to the frame 36, on the first charge sleeve side of the hole of the bearing portion 36*b*, and the portion of the bearing portion, on the opposite side of the hole of the bearing portion 36*b* from the first charge sleeve. The above-mentioned maximum value of 70 μm corresponds to the portion of the bearing portion 36*b*, which is on the opposite side of the hole of the bearing 36*b* from the first charge sleeve, and when the second charge sleeve is in contact with this portion of the bearing portion 36*b*.

In the case in which the structural arrangement disclosed in Japanese Laid-open Patent Application 06-130799 is employed as a countermeasure for this deformation of the frame, more specifically, the structural arrangement is applied to the frame, the lateral plates of which are formed of steel plate, which has been electroplated with zinc and which has a coefficient of linear expansion of $1.16\times10^{-5}$/° C., the change in the distance between the aforementioned holes of the lateral plate becomes roughly 7 μm. In other words, the difference between the change between the holes, and the change in the distance between the two charge sleeves, is roughly 63 μm. This change attributable to the thermal deformation cannot be fully absorbed. Therefore, at least one of the two sleeves is bent. If the first charge sleeve is bent, the distance between the regulation blade 37 and the first charge sleeve becomes nonuniform, rendering nonuniform the amount of magnetic particles coated on the first charge sleeve, in terms of the lengthwise direction of the sleeve. On the other hand, if the second charge sleeve is bent, the distance between the second charge sleeve and photosensitive drum, or/and the distance between the second charge sleeve and first charge sleeve, becomes nonuniform, rendering nonuniform the amount of magnetic particles coated on the second charge sleeve. The problems resulting from these changes in the amount of magnetic particles coated on the first charge sleeve, and the amount of magnetic particles coated on the second charge sleeve, are as described above. As for the method for calculating the amount of these changes, the deformations of the above-mentioned components, portions thereof, etc., of a charging apparatus were simulated based on their actual sizes and measurements, with the use of the finite element analysis.

As another effect of this embodiment, there is the stabilization of the positions of the magnetic poles of the magnet in the first charge sleeve 31, which are facing the photosensitive drum 1, relative to the photosensitive drum 1, in terms of the direction parallel to the moving direction of the peripheral surface of the photosensitive drum 1.

One of the problems that occur if the method, disclosed in U.S. Laid-open Patent Application 2002-0054773, for positioning a developing apparatus, is applied to the charging apparatus shown in FIG. 6 is that the positional relationship between the magnetic pole 33*a* of the stationary magnet in the magnet 33 in the first charge sleeve, and the photosensitive drum, in terms of the circumferential direction of the photosensitive drum, sometimes becomes unstable, rendering unstable the amount of magnetic particles that coat the second charge sleeve. This in turn affects the charging performance of the second charge sleeve 32. Consequently, the overall potential level to which the photosensitive drum 1 is charged by the charging apparatus is affected. This deviation in potential level is present immediately after the assembly of the charging apparatus, and affects an image forming apparatus in image density, in particular, in the image density of halftone areas, as soon as the image forming apparatus is put to use.

Further, as the magnetic pole 33*a* shifts in position, the amount of magnetic particles stagnating in the space 35*c* surrounded by the peripheral surfaces of the first charge sleeve 31, the second charge sleeve 32, and the photosensitive drum 1, increases, increasing substantially the amount by which the photosensitive drum 1 is shaved. This in turn nonuniformly changes (reduces) the thickness of the photosensitive layer of the photosensitive drum 1. As a result, even if the amount of exposure light is kept the same, an image, which is higher in image density across the portions which correspond to the portions of the photosensitive layer which has been reduced in thickness, is formed. This change in the potential level to which the potential of the charged peripheral surface of the photosensitive drum 1 attenuates as it is exposed is different from the above-described change in the potential level to which the peripheral surface of the photosensitive drum 1 is charged, in that this change is long-term, and therefore, the resultant formation of an image suffering from the deviation in image density by the image forming apparatus is long-term.

The problems which occur as the structural arrangement for the development apparatus, which is in accordance with the prior art, is applied to a charging apparatus were solved by this embodiment of the present invention. The movement of the first charge sleeve 31 in the directions indicated by the arrow marks A and B in FIG. 1 (direction of movement of peripheral surface of photosensitive drum) is regulated by the positioning portions 40*a*, 40*b*, 45*a*, and 45*b*. The magnetic pole 33*a* of the stationary magnet 33 in the first charge sleeve 31, which opposes the photosensitive drum, is stable in the position relative to the photosensitive drum, in terms of the circumferential direction of the photosensitive drum 1. Therefore, the amount of magnetic particles that coat the second charge sleeve 32 remains stable. Therefore, it does not occur that an image suffering from image density deviation is formed as soon as an image forming apparatus is put to use. Further, magnetic particles are prevented from stagnating in the space surrounded by the peripheral surfaces of the two sleeves and photosensitive drum. Therefore, the aforementioned long-term formation of an image suffering the image density deviation does not occur.

The following are the data regarding the shaving of the photosensitive drum, which occurs as the aforementioned stagnation of magnetic particles occurs.

The magnetic particles used in this embodiment are desired to be 10-100 μm in average diameter, 20-250 emu/cm$^3$ in saturation magnetization, and $10^2$-$10^{10}$Ω·cm in electrical resistance. For the purpose of improving a magnetic brush-based charging apparatus, the magnetic particles used as the material for the magnetic brush are desired to be as low as possible in electrical resistance. However, in consideration of the possibility that a photosensitive drum may have insulation defects such as pin-holes, the magnetic particles are desired to be no less than $10^6$Ω·cm in electrical resistance. The magnetic particles in this embodiment were formed of ferrite. Their electrical resistance was adjusted by surface oxidization and surface reduction. Then, they were subjected to the coupling process. They were 25 μm in average diameter, 200 emu/cm$^3$ in saturation magnetization, and $5\times10^6$Ω·cm in electrical resistance.

In this embodiment, in order to determine only the amount by which the photosensitive drum was shaved the charging apparatus, only the magnetic brush-based charging apparatus 30 and pre-exposure lamp 8 were left in the adjacencies of the peripheral surface of the photosensitive drum 1; other components were removed.

As the pre-exposure lamp, an LED which is 660 nm in wavelength was employed. By applying 120 V to the LED using an exposure power source 81, the photosensitive drum 1 was exposed at roughly 370 Lux/sec.

The diameter of the photosensitive drum 1 was 80 mm, and the peripheral velocity of the photosensitive drum 1 was 400 mm/sec. The diameters of the first and second charge sleeves are both 16 mm. The peripheral surfaces of the charge sleeves had been blasted with alundum #180. The distance between the first charge sleeve 31 and the photosensitive drum 1, and the distance between the second charge sleeve 32 and the photosensitive drum 1, were both set to roughly 340 μm, and the distance between the first charge sleeve 31 and the magnetic particle regulating blade 37 was set to roughly 600 μm. Incidentally, the blade 37 may be nonmagnetic. If the blade 37 is nonmagnetic, the blade 37 is desired to be positioned so that the position of the blade 37 does not coincide with that of one of the magnetic poles of the stationary magnet, in terms of the circumferential direction of the first charge sleeve 31; it is desired that magnetic particles are regulated in the area in which the magnetic brush lies flat. In such a case, it is desired that the distance between the first charge sleeve 31 and blade 37 is set to roughly 250 μm.

The charging apparatus frame was filled with 100 g of magnetic particles. In order to charge the photosensitive drum 1, the combination of a DC voltage (−600 V) and an AC voltage (300 Vpp in peak-to-peak voltage, and 1 kHz in frequency) was applied as charge bias to the first charge sleeve 31 by a charge bias applying apparatus 36, whereas to the second charge sleeve 32, the combination of a DC voltage (−500 V) and an AC voltage (300 Vpp in peak-to-peak voltage, and 1 kHz in frequency) was applied as charge bias.

With the two charge sleeves 31 and 32 rotated at the above-mentioned peripheral velocities, the amount of magnetic particles borne on each charge sleeve was roughly 65 mg/cm$^2$.

Under the above described conditions, the photosensitive drum 1 was rotated for a length of time equivalent to the formation of 70,000 copies of A4 size, without forming images. Then, the difference between the thickness of the surface layer of the photosensitive drum 1 before the start of the rotation of the photosensitive 1, and that after the above-mentioned rotation of the photosensitive drum 1, was obtained as the amount of the photosensitive drum wear. However, in order to make it possible to evaluate the above-described structural arrangement, in comparison with various other structural arrangements, the amount of the photosensitive drum wear was shown as the amount of photosensitive drum wear per 10,000 copies.

As an instrument for measuring the thickness of the surface layer of the photosensitive drum 1, an interference-based film thickness gauge (product of Oshima Electric Co., Ltd.) was used. The thickness of the surface layer of the photosensitive drum 1 was measured at seven points, with intervals of 4 cm, between the lengthwise center and lengthwise ends of the photosensitive drum 1.

The following is the comparison between the positioning method in this embodiment, and the positioning method, disclosed in U.S. Laid-open Patent Application 2000-0054773, in which both of the two sleeves are positioned with the use of the positioning rings, in terms of the amount of the photosensitive drum wear.

The results of the measurements of the thickness of the surface layer of the photosensitive drum 1 at the above-described seven points were averaged. In the case of this embodiment, the amount of the photosensitive drum wear was roughly 6 A/10000 copies. In the case of the structural arrangement in which the two sleeves were positioned with the use of the positioning rings alone, the amount of the photosensitive drum wear was not uniform in terms of the lengthwise direction of the photosensitive drum 1. For example, some areas of the peripheral surface of the photosensitive drum 1 were worn as much as roughly 39 A/10000 copies. As described above, the amount by which the photosensitive drum 1 is shaved affects the potential level to which the potential level of each of the charged numerous points of the peripheral surface of the photosensitive drum 1 attenuates as it is exposed. This shaving of the photosensitive drum 1 is directly related to the long-term deviation in image density.

The ardent examination of this charging apparatus employing the positioning rings revealed the following: The reason for the large amount of sharing of the photosensitive drum 1 was that magnetic particles stagnated between the first and second charge sleeves. In the case of the structural arrangement for the charging apparatus in this embodiment, there was no magnetic particle stagnation, and therefore, the amount by which the photosensitive drum 1 was shaved was smaller. This is why the image forming apparatus equipped with the charging apparatus in this embodiment did not suffer from the long-term deviation in image density.

Next, referring to FIG. 7, the means for driving the two charge sleeves of the charging apparatus in this embodiment will be described.

FIG. 7 is a drawing showing the gear train for driving the first and second charge sleeves.

In FIG. 7, designated by a reference symbol 81 is a first sleeve gear which is attached to the first charge sleeve and rotates with the first charge sleeve. Designated by a reference symbol 82 is a second sleeve gear which is attached to the second charge sleeve and rotates with the second charge sleeve. Designated by a reference symbol 83 is a first idler gear with which the charging apparatus is provided, and which rotates the first and second sleeve gears at the same time. Designated by a reference symbol 84 is a second idler gear with which the charging apparatus is provided, and which rotates the first idler gear. Designated by a reference symbol 85 is a driving force input gear for transmitting a driving force from the image forming apparatus to the charging apparatus. The first and second sleeve gears 81 and 82, the first idler gear 83, the second idler gear 84, etc., which make up the driving portion, are attached to the frame 36. The driving force input gear 85 is attached to the outward side of the frame 36. The two charge sleeves are equal in diameter. Thus, in order to render the two sleeve equal in peripheral velocity, the first and second sleeve gears are rendered the same in the number of teeth.

As for the amount of the torque for driving the two sleeves, the torque for driving the first charge sleeve 31 is rendered greater than that for the second charge sleeve 32, in particular, when the regulation blade is formed of nonmagnetic substance, and therefore, it is placed closer to the first charge sleeve 31 than the regulation blade formed of a magnetic blade. In other words, when the nonmagnetic blade is used, the amount of the torque for driving the charging apparatus is greater than when a magnetic blade is used, and therefore, the amount of force to which the charge apparatus 30 is subjected by the transmission of the driving force is greater. Therefore, some modifications need to be made regarding the direction in which the force for driving the charging apparatus is transmitted to the charging apparatus.

Thus, a structural arrangement is made to press the charging apparatus downward, that is, toward the photosensitive drum 1, so that each of the two magnetic particle bearing members is pressed upon the positioning members. With the employment of this structural arrangement, even if a large amount of torque becomes necessary to drive the first charge sleeve, the charging apparatus itself remains stable in position. More specifically, referring to FIG. 7, designated by a reference symbol L1 is a line connecting the axial lines of the two sleeves, and designated by reference symbols L2 and L3 are the lines which are perpendicular to the line L1 and coincide with the axial lines of the two sleeves, one for one. The charging apparatus is structured so that the point f at which the driving force input gear 85 meshes with the second idler gear 84, that is, the driving force input gear on the charging apparatus side, is between the two lines L2 and L3 perpendicular to the line L1, and also, so that as the driving force is transmitted onto the second idler gear 84 at the above-described point at which the gears 85 and 84 mesh with each other, it generates such pressure that presses the second idler gear 84 in the direction indicated by an arrow mark F in FIG. 7.

At this time, the method for ensuring that the distances among the two charge sleeves and photosensitive drum remain stable, that is, the gist of the present invention, will be described. The accuracy in these distances can be ensured by ensuring that the abovementioned sleeve supporting members 40 and 45 and photosensitive drum supporting members 40*f* and 40*f*, in particular, their supporting surfaces, are precisely processed. Further, if the two charge sleeves and photosensitive drum have to be more precisely positioned relative each other, the rings fitted around the lengthwise end portions of the sleeves may be adjusted in diameter to adjust the distances among the sleeves and the photosensitive drum. The diameter of each ring can be adjusted by ±10 μm during the molding process or shaving, in order to more precisely control the distance between each sleeve and the photosensitive drum. As a modification of this method, it is possible to separate the V-shaped sleeve supporting portions of the supporting member 40 and 45, that is, the portions having the supporting surfaces 40*a* and 40*b* and supporting surfaces 45*a* and 45*b*, from the photosensitive drum supporting portion 40*f* and 45*f*, respectively, so that the distance between the sleeve supporting portion and photosensitive drum supporting portion can be adjusted in their positions relative to each other, in order to ensure that the distances between the two sleeves and the photosensitive drum is precisely maintained. In this case, the distance between the two sleeves and the photosensitive drum may be adjusted by actually measuring the distances between the peripheral surface of each charge sleeve and photosensitive drum after the completion of the assembly of the charging apparatus. Of coarse, it is possible to adjust these distances by estimating the distances by measuring the surfaces of the supporting portions with the use of a three dimensional measuring method.

The rotational direction of the photosensitive drum 1 shown in FIG. 1 is opposite to the rotational direction of each charge sleeve of the charging apparatus. In this case, magnetic particles are more likely to stagnate than otherwise, as has been described in the section of this specification regarding the problems to be solved by the present invention. Therefore, the effect of this embodiment is more apparent in this case, in terms of the stagnation of magnetic particles. Incidentally, even if the rotational direction of the photosensitive drum 1 is the same as the rotational direction of each charge sleeve, that is, it is opposite to the direction indicated by the arrow mark in FIG. 1, the effects of this embodiment upon the stability in the amounts of magnetic particles coated on the charge sleeves, and the ease with which the charging apparatus can be assembled, are exactly the same as those if the rotational direction of the photosensitive drum is opposite to the rotational direction of each charge sleeve.

This embodiment was described with reference to an a-Si-based photosensitive drum. However, the charging apparatus in this embodiment is also compatible with a photosensitive member based on an organic photosensitive substance.

As for the pressing means for keeping the positioning rings fitted around the lengthwise end portions of each charge sleeve, in contact with the positioning surfaces of the positioning members, they may be made up of pressing portions 61 and 63 and compression springs 62 and 64, such as those shown in FIG. 5. Such pressing means are advantageous over the pressing means, shown in FIG. 4, made up of pressing members, and screws for fastening the pressing members, in that the amount of the pressure can be more easily adjusted by the former than by the latter.

As described above, compared to a charging apparatus in accordance with any of the prior arts, the charging apparatus in this embodiment is superior in that it is easier to assemble; the first charge sleeve, that is, the charge sleeve on the magnetic particle regulating blade side, is prevented from shifting in position in the upstream and downstream direction, in terms of the moving direction of the peripheral surface of the photosensitive drum, whereas the second charge sleeve is afforded latitude in movement in the abovementioned directions, stabilizing thereby the amount of magnetic particles coated on the charge sleeves. Therefore, not only is the charging apparatus stable in image density in the short-term, but also, in the long-term.

Further, even if the amount of the torque necessary to drive the sleeves increases, the distance between each charge sleeve and the photosensitive drum is precisely maintained at a preset level.

Embodiment 2

Next, referring to FIGS. 10 and 11, the second embodiment of the present invention will be described.

This embodiment is different from the first one in the positioning portion for regulating the distance between the second charge sleeve and the photosensitive drum; except for the structure of the positioning portion, the second embodiment is the same as the first one. Therefore, the operation and effects of the charging apparatus in this embodiment, which are similar to those in the first embodiment will be not described.

Figure 10:
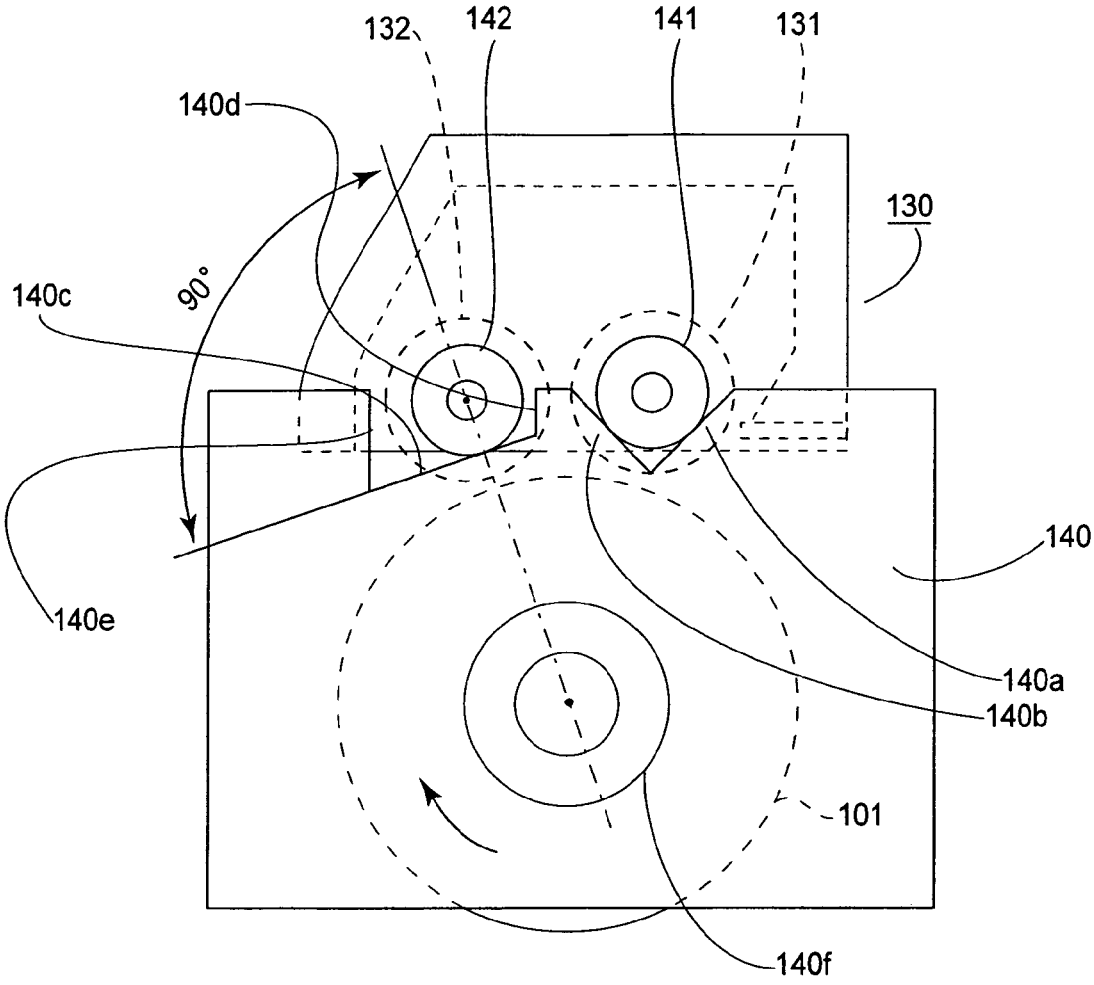
FIG. 10 is a drawing showing the positioning portion in the second embodiment of the present invention.
Figure 11:
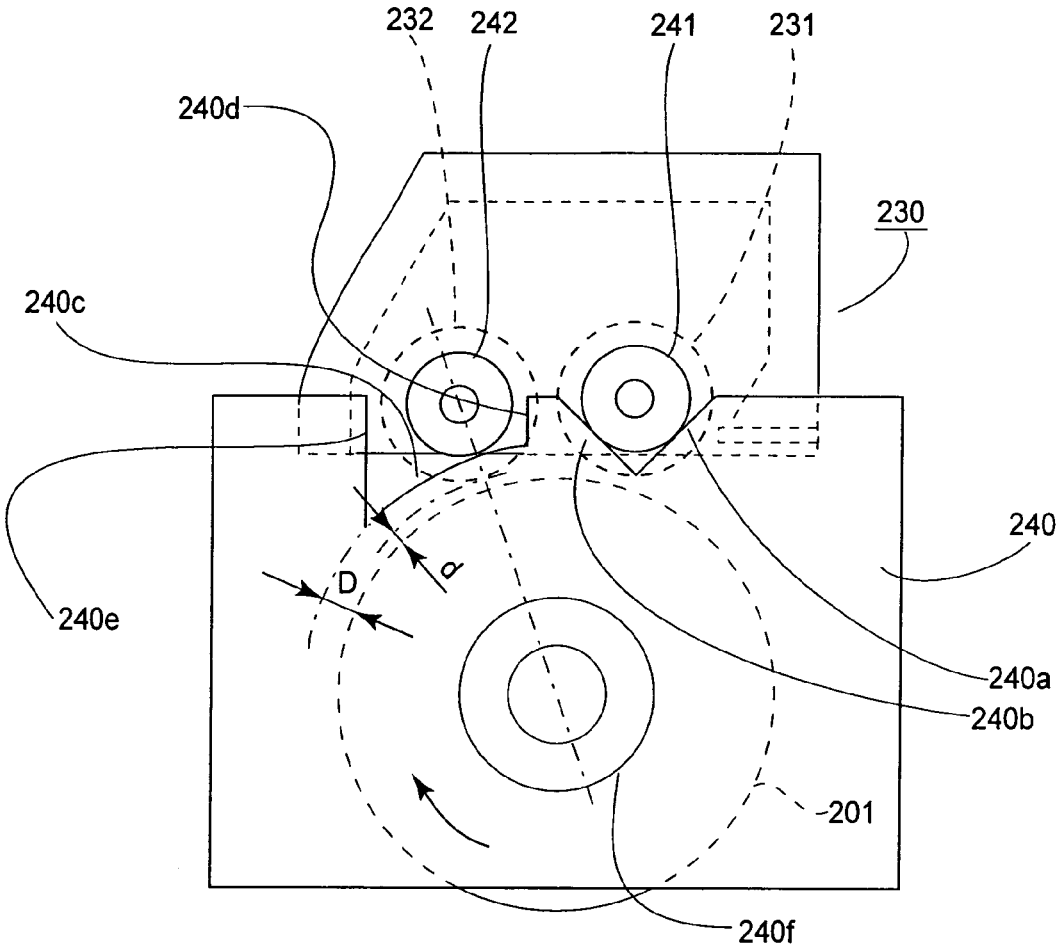
FIG. 11 is a drawing showing one of the modified versions of the positioning portion in the second embodiment.

FIGS. 10 and 11 are drawings showing the structure of the charging apparatus, in accordance with the present invention, for positioning the first and second charge sleeves.

First, referring to FIG. 10, the method for positioning the first and second charge sleeves of the charging apparatus in accordance with the present invention will be described. FIGS. 10 and 11 show only the positioning portion on the front side, and the lengthwise front end of each charge sleeve. The positioning portion on the rear side, and the lengthwise rear end of each charge sleeve, are similar to those on the front side, and therefore, will not be described.

In FIG. 10, designated by a reference numeral 101 is a photosensitive drum, and designated by a reference numeral 130 is a charging apparatus. Designated by reference numerals 131 and 132 are first and second charge sleeves, respectively. Designated by a reference numeral 140 is a positioning member for positioning both the lengthwise front end of the photosensitive drum 101 and the front end of the charging apparatus 130. Designated by reference numeral 141 and 142 are positioning rings fitted around the front end portions of the first and second charge sleeves to position the front end portions of the first and second charge sleeves 131 and 132, respectively. Designated by reference symbols 140*a* and 140*b* are positioning portions of the first charge sleeve 131. Designated by a reference symbol 140*c* is the positioning portion of the second charge sleeve 132, which is for controlling the distance between the second charge sleeve 132 and photosensitive drum 101. Designated by a reference symbol 140*d* is a stopper portion for preventing the second charge sleeve 132 from coming within a preset distance from the first charge sleeve 131, whereas designated by a reference symbol 140*e* is a stopper portion for preventing the second charge sleeve 132 from moving away from the first charge sleeve 132 by no less than a preset distance. Designated by a referential symbol 140*f* is a bearing portion by which the photosensitive drum 101 is held.

Next, the operation of the charging apparatus in this embodiment will be described.

In terms of the method for regulating magnetic particles on the first and second charge sleeves, and the method for transferring magnetic particles between the first and second charging sleeves, this embodiment is the same as the first embodiment.

However, this embodiment is different from the first one in that the positioning portion, in this embodiment, for controlling the distance between the second charge sleeve 132 and the photosensitive drum 101 is different from the positioning portion in the first embodiment. The positioning portion 140*c* is the flat surface of the positioning portion 140, with which the positioning ring 142 remains in contact, as is the positioning portion 40*c* in the first embodiment is the flat surface of the positioning portion 40, with which the positioning ring 42 remains in contact. The difference here is that this flat surface in this embodiment is parallel to the line tangential to the peripheral surface of the photosensitive drum 101 at the point thereof closest to the second charge sleeve 132. In other words, the positioning surface 140*c* is perpendicular to the line connecting the axial lines of the first charge sleeve 132 and the photosensitive drum 101.

This point at which the distance between the second charge sleeve and the photosensitive drum is smallest is used as the basic position, or reference position, for the second charge sleeve. In the first embodiment, if the distance between the first and second charge sleeves changes as in the first embodiment, the second charge sleeve shifts from its basic position. In the second embodiment, however, the deviation in the distance between the second charge sleeve 132 and the photosensitive drum 101 can be made smaller than the deviation between the second charge sleeve 32 and photosensitive drum 1 in the first embodiment. This means that the charging apparatus in the second embodiment is more stable in terms of the charging performance of the second charge sleeve, being therefore more stable in image density, than that in the first embodiment.

Shown in FIG. 11 is one of the modifications of the structure, in the second embodiment, for ensuring that the distance between the second charge sleeve and the photosensitive drum remains within a preset range.

FIG. 11 shows only the positioning portion on the front side, and the lengthwise front end of each charge sleeve, as does FIG. 10. The positioning portion on the rear side, and the lengthwise rear end of each charge sleeve, are the similar to those on the front side, and therefore, will not be described.

In FIG. 11, designated by a reference symbol 201 is a photosensitive drum, and designated by a reference symbol 230 is a charging apparatus. Designated by reference symbols 231 and 232 are first and second charge sleeves, respectively. Designated by a reference symbol 240 is a positioning member for positioning both the lengthwise front end of the photosensitive drum 201 and the front end of the charging apparatus 230. Designated by reference symbols 241 and 242 are positioning rings fitted around the front end portions of the first and second charge sleeves to position the front end portions of the first and second charge sleeves 231 and 232, respectively. Designated by reference symbols 240*a* and 240*b* are positioning portions for positioning the first charge sleeve 231. Designated by a reference symbol 240*c* is the positioning portion for positioning the second charge sleeve 232, which is for controlling the distance between the second charge sleeve 232 and the photosensitive drum 201. Designated by a reference symbol 240*d* is a stopper portion for preventing the second charge sleeve 232 from coming within a preset distance from the first charge sleeve 231, whereas designated by a reference symbol 240*e* is a stopper portion for preventing the second charge sleeve 232 from moving away from the first charge sleeve 232 by a distance no less than a preset one. Designated by a reference symbol 240*f* is a bearing portion by which the photosensitive drum 201 is held.

The charging apparatus shown in FIG. 11 is different from the one shown in FIG. 10, in the positioning portion 240*c* which controls the distance between the second charge sleeve 232 and the photosensitive drum 201; the positioning portion 240*c*, that is, the positioning surface 240*c*, shown in FIG. 11, is arcuate. The curvature of this arcuate positioning surface 240*c* is such that after the attachment of the photosensitive drum 201, this arcuate positioning surface 240*c* is concentric with the peripheral surface of the photosensitive drum 201. Further, the supporting member 240 in this modification is structured so that the distance D between the second charge sleeve 232 and the photosensitive drum 201 remains constant.

Therefore, even if the distance between the first and second charge sleeves varies, the distance d between the second charge sleeve 232 and photosensitive drum 201 does not change, unlike the distance between the second charge sleeve 132 and photosensitive drum 101 of the charging apparatus in the first embodiment shown in FIG. 10. This means that the charging apparatus in this embodiment is more stable in the charging performance of the second charge sleeve, being therefore more stable in terms of image density, compared to the structural arrangement in the first embodiment and the structural arrangement shown in FIG. 10.

As the method for giving the positioning surface 240*c* a precise curvature, it is possible to form the positioning portion 240 of resin, or to mold the positioning portion 240 of aluminum or the like, by die casting. Further, it is possible to mold the positioning portion 240 of a metallic substance such as aluminum, by extrusion. A positioning portion, the positioning surface of which has a satisfactory (precise) curvature, can be formed by any of the above-mentioned method.

Incidentally, even if such an electrophotographic photosensitive member as an electrophotographic photosensitive belt, which is not cylindrical, is employed in place of the photosensitive drum, the effect of this modified version of the second embodiment can be realized by forming the positioning members so that the gap between the portion of the photosensitive belt, which opposes the second charge sleeve, and the second charge sleeve, becomes uniform in terms of the moving direction of the surface of the photosensitive belt.

As described above, not only can the charging apparatus in this embodiment realize the effect realized by the charging apparatus in the first embodiment, but also, can more precisely maintain the distance between the second charge sleeve and the photosensitive drum, being therefore more stable in charging performance than the charging apparatus in the first embodiment. In other words, it is substantially smaller in such image density deviation that possibly occurs as soon as a charging apparatus is put to use for the first time, than the image forming apparatus in the preceding embodiments.

Embodiment 3

Next, referring to FIGS. 12 and 13, the third embodiment of the present invention will be described.

This embodiment is characterized in that unlike the first embodiment, the stopper portion for regulating the excessive shifting of the second charge sleeve relative to the first charge sleeve is disposed within the frame of the charging apparatus.

Except for the structure of this stopper portion, this embodiment is the same as the first and second embodiments. The operation of the charging apparatus in this embodiment, which is similar to that in the first embodiment, and the effects of this embodiment, which are similar to those of the first embodiment, will not be described.

Figure 12:
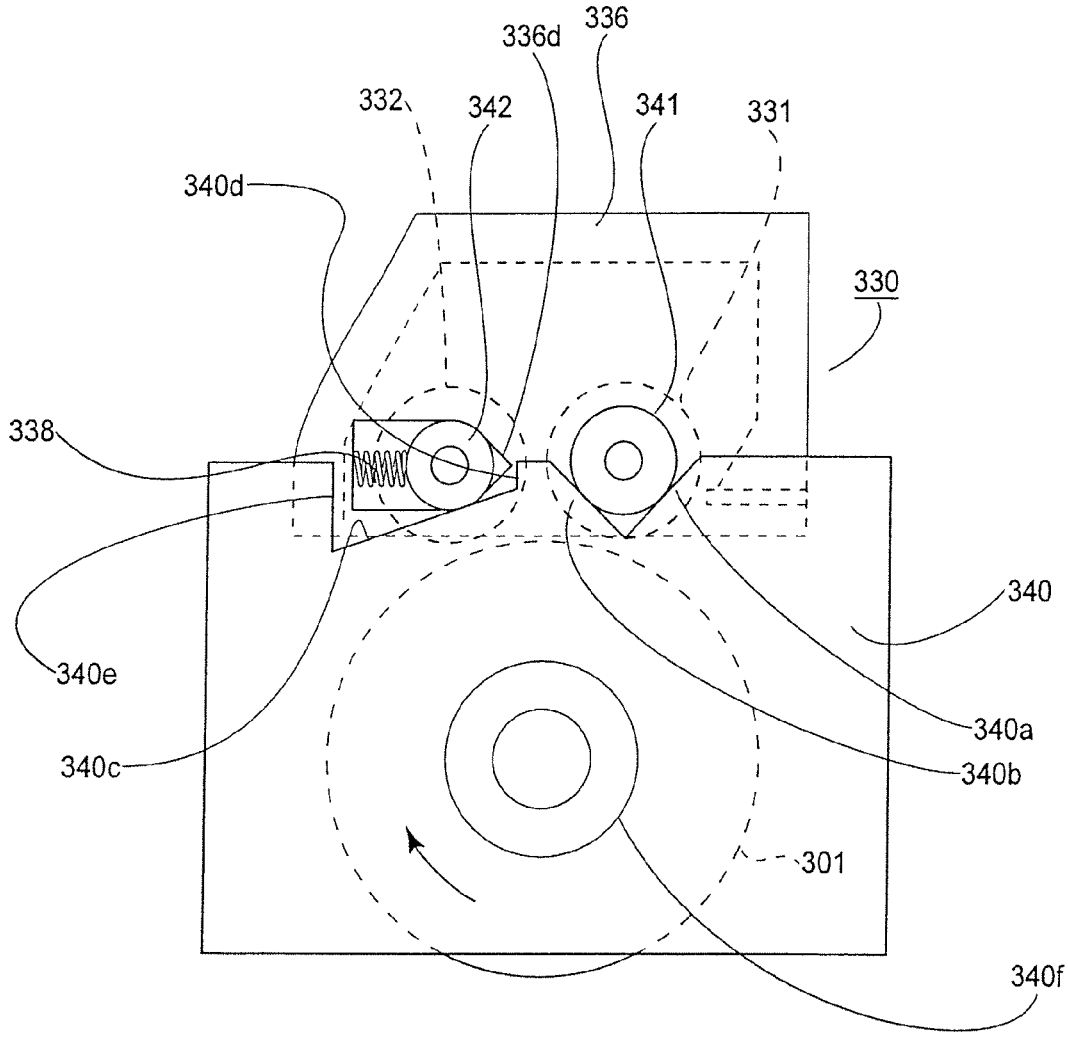
FIG. 12 is a drawing showing the positioning portion in the third embodiment of the present invention.

FIG. 12 is a drawing of the positioning portion of the charging apparatus, in this embodiment, for positioning the first and second charge sleeves, showing the structure thereof. FIG. 13 is a drawing of the frame of the charging apparatus to which the charge sleeves have been attached, showing the structure thereof.

Figure 13:
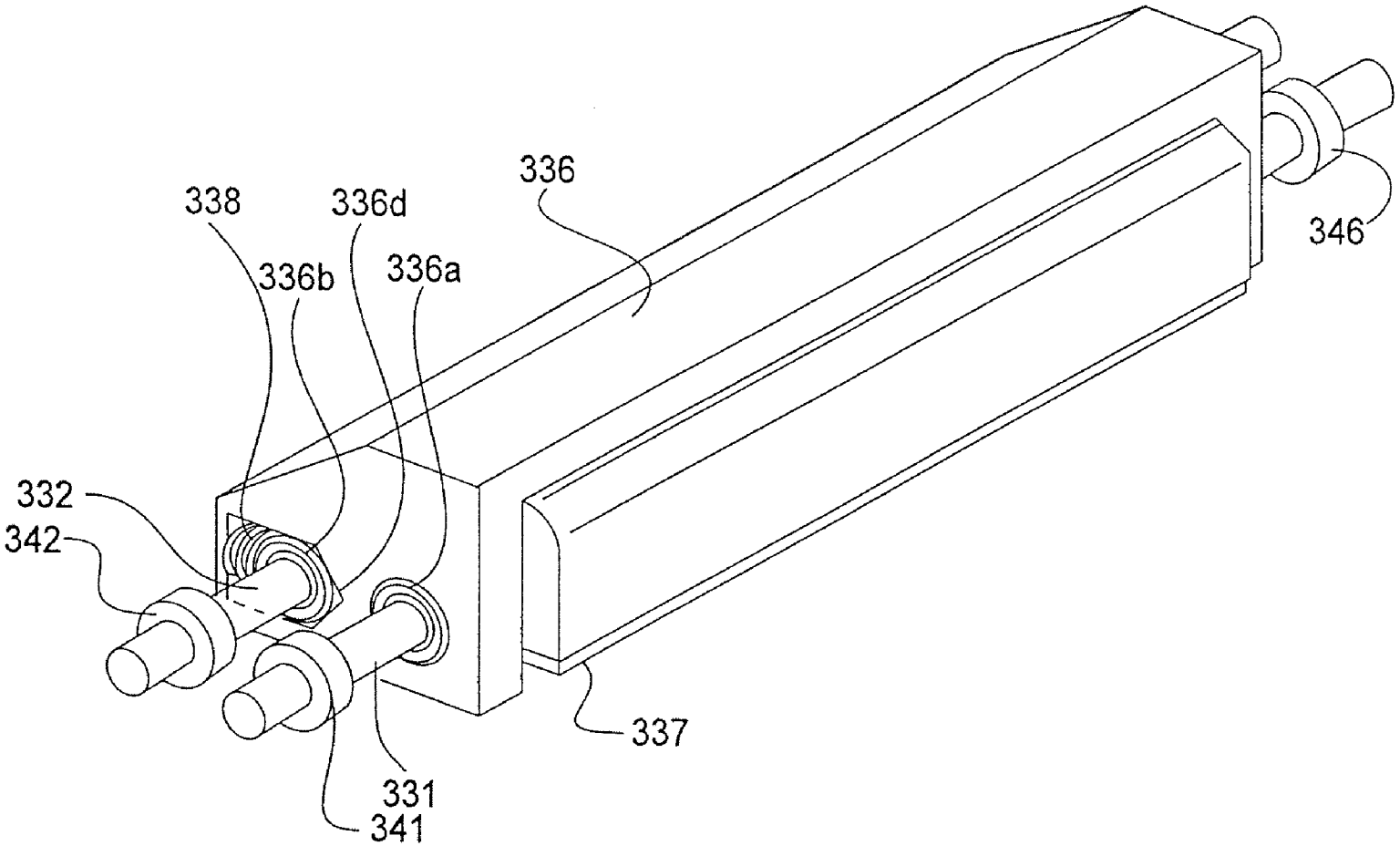
FIG. 13 is a drawing showing the charging portion in the third embodiment of the present invention.

In FIGS. 12 and 13, designated by a reference symbol 301 is a photosensitive drum, and designated by a reference symbol 330 is a charging apparatus. Designated by reference symbols 331 and 332 are first and second charge sleeves, respectively. Designated by a reference symbol 340 is a positioning member for positioning both the lengthwise front end of the photosensitive drum 301 and the front end of the charging apparatus 330. Designated by reference symbols 341 and 342 are positioning rings fitted around the front end portions of the first and second charge sleeves to position the front end portions of the first and second charge sleeves 331 and 332, respectively. Designated by reference symbols 340*a* and 340*b* are positioning portions for positioning the first charge sleeve 331. Designated by a reference symbol 340*c* is the positioning portion for positioning the second charge sleeve 332, which is for controlling the distance between the second charge sleeve 332 and the photosensitive drum 301.

Designated by a reference symbol 336 is a frame to which the first charge sleeve 331 and second charge sleeve 332 are attached. Designated by a reference symbol 340*d* is a stopper portion for preventing the second charge sleeve 332 from coming within a preset distance from the first charge sleeve 331, whereas designated by a reference symbol 340*e* is a stopper portion for preventing the second charge sleeve 332 from moving away from the first charge sleeve 332 by no less than a preset distance. Designated by a reference symbol 338 is a compression spring for pressing the second charge sleeve 332, and a bearing portion 336*b*, which bears the second charge sleeve 332 and is held by the frame 336, toward the stopper 336*d*.

In this embodiment, the basic position of the second charge sleeve 332 is the position in which the second charge sleeve 332 is while the second charge sleeve 332 is kept in contact with the stopper portion 336*d* by the compression spring 338. In other words, the charging apparatus is structured so that the second charge sleeve 332 does not come closer to the first charge sleeve 331 beyond this basic position.

Designated by a reference symbol 340*f* is a bearing portion by which the photosensitive drum 301 is held.

Regarding the shifting of the second charge sleeve 332, it is previously stated, in the description of the first embodiment, that it is preferred that a second charge sleeve is allowed to shift in position within a preset range. In this embodiment, the stopper portions for preventing the excessive shifting of the second charge sleeve 332 toward, or away from, the first charge sleeve 331, are disposed in the frame of the charging apparatus, in order to afford the second charge sleeve 332 some latitude in terms of the shifting in the above-mentioned directions.

Next, the operation of the charging apparatus in this embodiment will be described. If the distance between the first and second charge sleeves increases for a certain length of time or momentarily, the amount of magnetic particles coated on the first charge sleeve increases, and therefore, the magnetic particles having moved past the gap between the first charge sleeve and the photosensitive drum are likely to stagnate in the space surrounded by the peripheral surfaces of the photosensitive drum and two charge sleeves. As the magnetic particles stagnate in this space, the pressure applied by the body of the magnetic particles upon the photosensitive drum, and the pressure applied by the body of the magnetic particles upon each of the two charge sleeves, increase. Since the second charge sleeve is held by the compression spring (under the pressure from the compression spring), only the second charge sleeve is allowed to move, that is, it moves away from the first charge sleeve. This prevents the magnetic particles from stagnating in the above-mentioned space by an excessively amount, and therefore, the amount by which the second charge sleeve is coated by the magnetic particles is prevented from excessively increasing. Further, the space in which the magnetic particles are likely to stagnate does not excessively increase in magnetic particle pressure, since the second charging sleeve 332 is pushed back to its basic position by the pressure from the compression spring 338.

Regarding the above-described sequential movement of the second charge sleeve, the accuracy in the distance between the second charge sleeve and the photosensitive drum is ensured because the positioning portion 340*c* is kept in contact with the ring 342, by an unshown pressing means.

As described above, not only does this embodiment have the same effects as those realized by the first embodiment, but also, it is capable of preventing magnetic particles from stagnating, whether the change in the distance between the second charge sleeve and first charge sleeve is long-term, or momentary. Therefore, the amount by which the photosensitive drum is shaved is minimized, and therefore, the image forming apparatus is prevented from becoming unstable in terms of image density.

Embodiment 4

Next, referring to FIGS. 14 and 15, the fourth embodiment of the present invention will be described.

This embodiment is characterized in that unlike the first embodiment, the distance between the second charge sleeve and the photosensitive drum is maintained by a pair of spacer rings (positioning portions) fitted around the lengthwise end portions of the second charge sleeve, one for one, to be placed in contact with the peripheral surface of the photosensitive drum.

Except for the addition of this spacer rings, this embodiment is the same as the first embodiment. Therefore, the operation of the charging apparatus in this embodiment, which is similar to that in the first embodiment, and the effects of this embodiment, which are similar to those of the first embodiment, will not be described.

Figure 14:
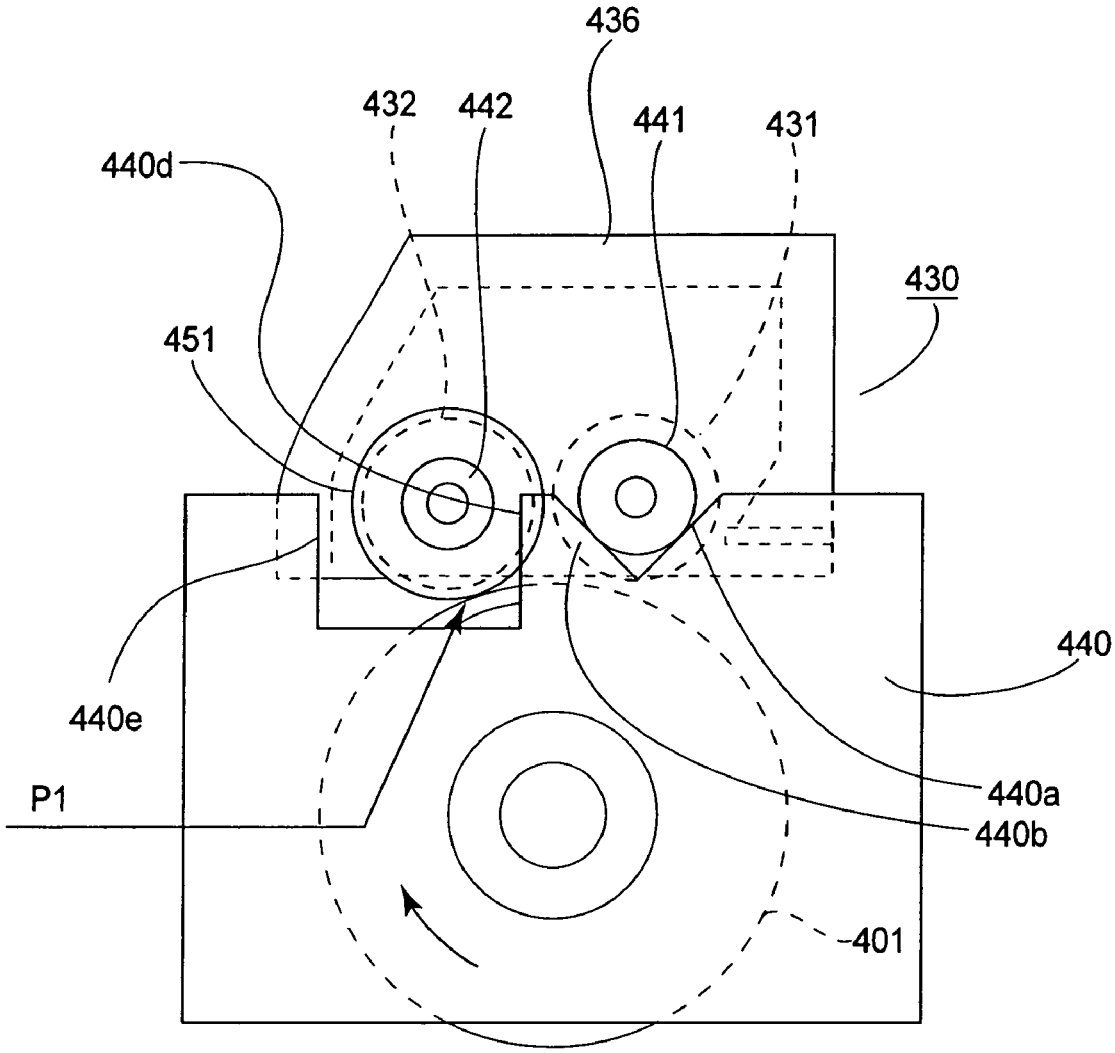
FIG. 14 is a drawing showing the positioning portion in the fourth embodiment of the present invention.

FIG. 14 is a drawing of the positioning portion of the charging apparatus, in this embodiment, for positioning the first and second charge sleeves, showing the structure thereof. FIG. 15 is a drawing of the charging apparatus to which an electrophotographic member as the photosensitive drum sleeves have been attached, showing the structure thereof.

Figure 15:
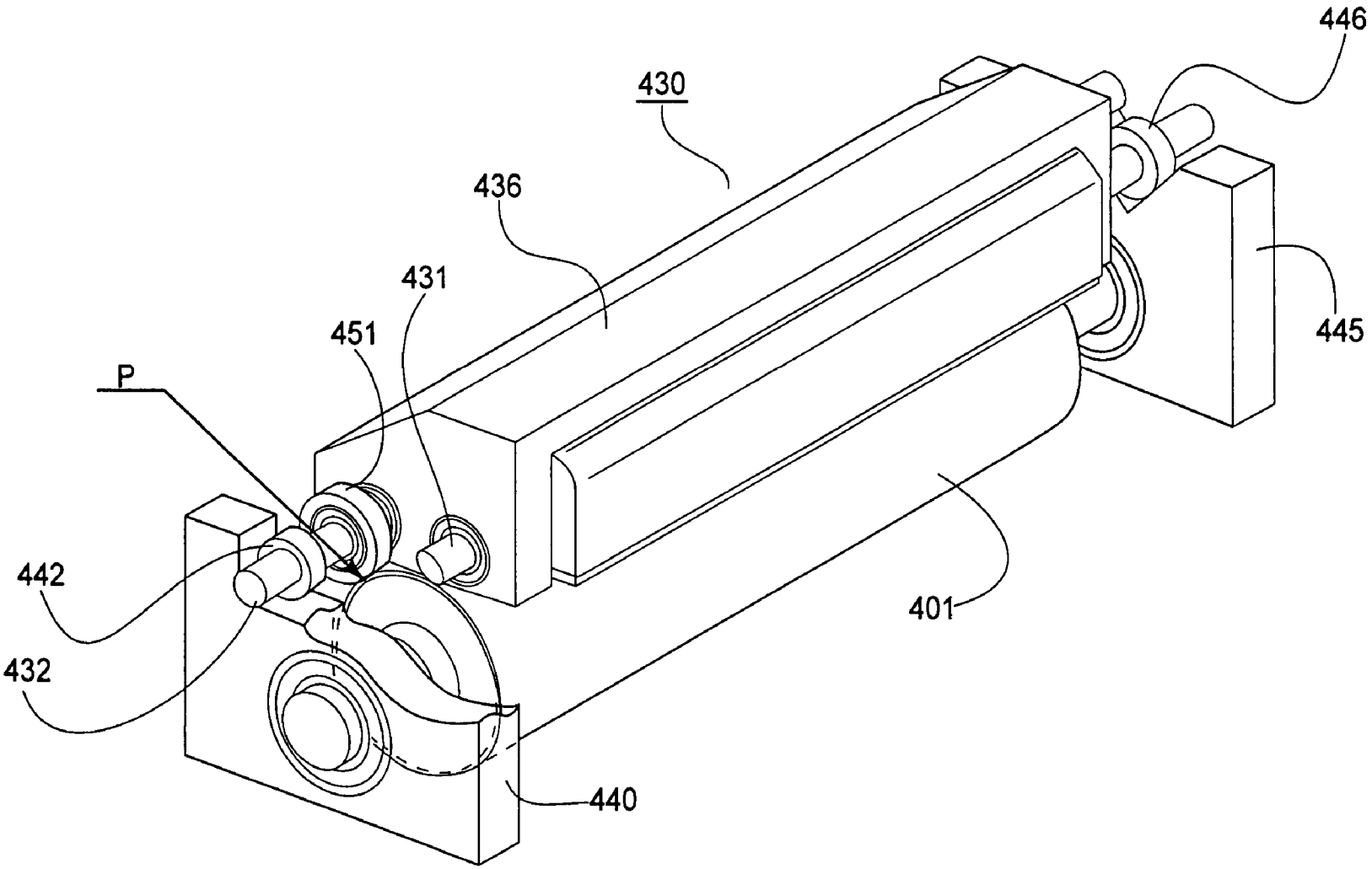
FIG. 15 is a drawing showing the state of the charging apparatus in the fourth embodiment after its assembly.

In FIGS. 14 and 15, designated by a reference symbol 401 is a photosensitive drum, and designated by a reference symbol 430 is a charging apparatus. Designated by reference symbols 431 and 432 are first and second charge sleeves, respectively. Designated by a reference symbol 440 is a positioning member for positioning both the lengthwise front end of the photosensitive drum 401 and the front end of the charging apparatus 430 in the drawings. Designated by reference symbols 441 and 442 are positioning rings fitted around the front end portions of the first and second charge sleeves to position the front end portions of the first and second charge sleeves 431 and 432, respectively. Designated by reference symbols 440*a* and 440*b* are positioning portions for positioning the first charge sleeve 431. Designated by a reference symbol 451 is a spacer ring fitted around the lengthwise front end portion of the second charge sleeve to be placed in contact with the photosensitive drum. The spacer ring 451 is positioned inward of the frame 436 relative to the spacer ring 432.

In FIG. 15, some parts of the supporting member 440 and the first charge sleeve 430 are now shown to show the state of contact between the photosensitive drum 401 and spacer ring 451.

Designated by a reference symbol 436 is a frame to which the first charge sleeve 431 and second charge sleeve 432 are attached. Designated by a reference symbol 440*d* is a stopper portion for preventing the second charge sleeve 432 from coming within a preset distance from the first charge sleeve 431, whereas designated by a reference symbol 440*e* is a stopper portion for preventing the second charge sleeve 432 from moving away from the first charge sleeve 432 by no less than a preset distance.

Designated by a reference symbol 440*f* is the bearing portion by which the photosensitive drum 401 is supported.

Next, the operation of the charging apparatus in this embodiment will be described.

First, the method for attaching the charging apparatus 430 to the supporting member 440 will be described. The first charge sleeve 431 is placed on the supporting member 440 so that the spacer rings 441 (and 446) fitted around the lengthwise front (and rear) end portions of the first charge sleeve 431 are rested on the positioning portion 440*a* and a positioning portion of a support member 445, respectively. As for the second charge sleeve 432, it is disposed so that the spacer ring 451 fitted around the lengthwise front end portion of the second charge sleeve 432, (spacer ring fitted on lengthwise read end portion is not shown) is placed in contact with the peripheral surface of the photosensitive drum 401. The spacer ring 451 is a ring, the external diameter of which is larger by a preset value than the external diameter of the second charge sleeve 432, which is 16 mm, for example, so that a preset distance is maintained between the second charge sleeve 432 and photosensitive drum 401. That is, if it is desired that a distance of 340 μm, for example, is provided between the second charge sleeve 432 and photosensitive drum 401, rings which are 16.68 mm in diameter are employed as the spacer rings 451.

Further, in order to ensure that the four spacer rings are kept perfectly in contact with the positioning surfaces or the peripheral surface of the photosensitive drum, the four spacer rings are kept pressed by an unshown pressing means. Regarding this pressing means, the member for pressing the spacer rings fitted around the first charge sleeve, and the member for pressing the spacer rings fitted around the second charge sleeve, may be separated; in order to press the spacer rings of the second charge sleeve, the entirety of the frame 436 may be pressed by a compression springs, for example. Unlike the structural arrangement, disclosed in U.S. Laid-open Patent Application 2002-0054773, which positions both charge sleeves with the use of only spacer rings, the structural arrangement in this embodiment does not allow the stationary magnet in the first charge sleeve to change in position, thereby preventing the amount by which the charge sleeves are coated by magnetic particles, from being changed by the movement of the magnetic poles of the stationary magnet in the charge sleeve.

Further, the second charge sleeve is fitted with the spacer rings 442 which are to be placed in contact with the stopper portions. Therefore, the contact between the spacer rings 442 and the stopper portions 440*d* and 440*e* prevents the second charge sleeve from excessively shifting in position. This set-up is the same as the one in the first embodiment.

As for the effects that characterize this embodiment, by regulating the shifting in position of the first charge sleeve, not only is it possible to provide the same effects as those provided by the first embodiment, but also, it is possible to more precisely control the distance between the peripheral surfaces of the second charge sleeve and the photosensitive drum.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 354185/2004 filed Dec. 7, 2004 which is hereby incorporated by reference.

What is claimed is:

1. A charging apparatus for electrically charging a member to be charged while magnetic particles are in contact with the member to be charged, said apparatus comprising:

a first magnetic particle carrying member configured and positioned to carry the magnetic particles;

a second magnetic particle carrying member configured and positioned to carry the magnetic particles, said second magnetic particle carrying member being disposed downstream of said first magnetic particle carrying member with respect to a feeding direction of the magnetic particles at a portion where said first magnetic particle carrying member and the member to be charged are opposed to each other, a frame supporting both of said first magnetic particle carrying member and said second magnetic particle carrying member;

wherein the magnetic particles are commonly used by said first magnetic particle carrying member and said second magnetic particle carrying member; and a regulating portion configured and positioned to regulate the amount of the magnetic particles carried on said first magnetic particle carrying member, at a position upstream of the portion where said first magnetic particle carrying member and the member to be charged are opposed to each other, with respect to the feeding direction of the magnetic particles;

wherein said first magnetic particle carrying member is supported so as to be regulated in the movement thereof, and wherein said second magnetic particle carrying member is capable of laterally shifting to change the distance between said first magnetic particle carrying member and said second magnetic particle carrying member.

2. An apparatus according to claim 1, wherein said second magnetic particle carrying member is movable in a direction parallel with a tangent line between said second magnetic particle carrying member and the member to be charged at a position where said second magnetic particle carrying member and the member to be charged are closest to each other.

3. An apparatus according to claim 1, wherein said second magnetic particle carrying member is movable so as to maintain a predetermined distance between said second magnetic particle carrying member and the member to be charged.

4. An apparatus according to claim 1, further comprising an urging member configured and positioned to urge said second magnetic particle carrying member in a direction to a stopper portion for preventing said second magnetic particle carrying member from approaching toward said first magnetic particle carrying member.

5. An apparatus according to claim 1, further comprising a first positioning portion configured and positioned to regulate movement of said first magnetic particle carrying member, and a second positioning portion configured and positioned to regulate movement of said second magnetic particle carrying member, wherein said first positioning portion and said second positioning portion are provided on a supporting member configured and positioned to support the member to be charged.

6. An apparatus according to claim 5, wherein said first positioning portion and said second positioning portion each has a configuration opening in a direction opposite the member to be charged.

7. An apparatus according to claim 1, wherein said second magnetic particle carrying member is provided with an abutting portion configured and positioned to abut the member to be charged to maintain a gap between said second magnetic particle carrying member and the member to be charged.

8. An apparatus according to claim 1, further comprising a frame supporting said first magnetic particle carrying member and said second magnetic particle carrying member, and a common driver configured and positioned to drive said first magnetic particle carrying member and said second magnetic particle carrying member, wherein the direction of a driving force transmitted to said driver from outside of said frame is toward the member to be charged.

9. An apparatus according to claim 1, further comprising magnetic field generating means provided in said first magnetic particle carrying member and magnetic field generating means provided in said second magnetic particle carrying member, wherein magnetic poles of said magnetic field generating means of said first magnetic particle carrying member and said magnetic field generating means of said second magnetic particle carrying member are opposite to each other at a position where said first magnetic particle carrying member and said second magnetic particle carrying member are opposed to each other.

10. An apparatus according to claim 1, further comprising:

a first positioning portion configured and positioned to regulate movement of said first magnetic particle carrying member; and a second positioning portion configured and positioned to regulate movement of said second magnetic particle carrying member, wherein said second positioning portion regulates the movement of said second positioning portion so as to substantially maintain the distance between said second magnetic particle carrying member and the member to be charged.

11. An apparatus according to claim 1, further comprising:

a first positioning portion configured and positioned to regulate movement of said first magnetic particle carrying member; and a stopper portion configured and positioned to regulate movement of said second magnetic particle carrying member, wherein said stopper portion regulates the movement of said second positioning portion so as to prevent the distance between said first magnetic particle carrying member and said second magnetic particle carrying member from decreasing beyond a predetermined distance.

12. A process cartridge detachably mountable to a main assembly of an image forming apparatus, comprising:

a member to be charged, configured and positioned to carry an electrostatic latent image;

a charging device configured and positioned to electrically charge the member to be charged while magnetic particles are in contact with the member to be charged, said charging device including:

a first magnetic particle carrying member configured and positioned to carry the magnetic particles;

a second magnetic particle carrying member configured and positioned to carry the magnetic particles, said second magnetic particle carrying member being disposed downstream of said first magnetic particle carrying member with respect to a feeding direction of the magnetic particles at a portion where said first magnetic particle carrying member and the member to be charged are opposed to each other, a frame supporting both of said first magnetic particle carrying member and said second magnetic particle carrying member, wherein the magnetic particles are commonly used by said first magnetic particle carrying member and said second magnetic particle carrying member, and a regulating portion configured and positioned to regulate the amount of the magnetic particles carried on said first magnetic particle carrying member, at a position upstream of the portion where said first magnetic particle carrying member and the member to be charged are opposed to each other, with respect to the feeding direction of the magnetic particles;

wherein said first magnetic particle carrying member is supported so as to be regulated in the movement thereof, and wherein said second magnetic particle carrying member is capable of laterally shifting to change the distance between said first magnetic particle carrying member and said second magnetic particle carrying member.

13. An image forming apparatus comprising:

a member to be charged, configured and positioned to carry an electrostatic latent image;

a charging device configured and positioned to electrically charge the member to be charged while magnetic particles are in contact with the member to be charged, said charging device including:

a first magnetic particle carrying member configured and positioned to carry the magnetic particles;

a second magnetic particle carrying member configured and positioned to carry the magnetic particles, said second magnetic particle carrying member being disposed downstream of said first magnetic particle carrying member with respect to a feeding direction of the magnetic particles at a portion where said first magnetic particle carrying member and the member to be charged are opposed to each other;

a frame supporting both of said first magnetic particle carrying member and said second magnetic particle carrying member, wherein the magnetic particles are commonly used by said first magnetic particle carrying member and said second magnetic particle carrying member; and a regulating portion configured and positioned to regulate the amount of the magnetic particles carried on said first magnetic particle carrying member, at a position upstream of the portion where said first magnetic particle carrying member and the member to be charged are opposed to each other, with respect to the feeding direction of the magnetic particles;

wherein said first magnetic particle carrying member is supported so as to be regulated in the movement thereof, and wherein said second magnetic particle carrying member is capable of laterally shifting to change the distance between said first magnetic particle carrying member and said second magnetic particle carrying member.

* * * * *